US011428463B2

(12) United States Patent
Ducote, Jr. et al.

(10) Patent No.: US 11,428,463 B2
(45) Date of Patent: Aug. 30, 2022

(54) MIXED REFRIGERANT SYSTEM AND METHOD

(71) Applicant: Chart Energy & Chemicals, Inc., Ball Ground, GA (US)

(72) Inventors: Douglas A. Ducote, Jr., The Woodlands, TX (US); Timothy P. Gushanas, Pearland, TX (US); Peter J. Turner, The Woodlands, TX (US); Michael Malsam, Sugar Land, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 172 days.

(21) Appl. No.: 16/545,695

(22) Filed: Aug. 20, 2019

(65) Prior Publication Data

US 2020/0041179 A1 Feb. 6, 2020

Related U.S. Application Data

(63) Continuation-in-part of application No. 14/218,949, filed on Mar. 18, 2014, now Pat. No. 10,480,851.

(60) Provisional application No. 61/802,350, filed on Mar. 15, 2013.

(51) Int. Cl.
*F25J 1/02* (2006.01)
*F25J 1/00* (2006.01)

(52) U.S. Cl.
CPC ..... *F25J 1/0244* (2013.01); *F25J 1/0055* (2013.01); *F25J 1/0212* (2013.01); *F25J 1/0262* (2013.01); *F25J 2290/32* (2013.01)

(58) Field of Classification Search
CPC ..... F25J 1/0244; F25J 1/0055; F25J 1/0212; F25J 1/0262; F25J 2290/32
See application file for complete search history.

(56) References Cited

U.S. PATENT DOCUMENTS

| | | | |
|---|---|---|---|
| 2,041,725 | A | 5/1936 | Podbielniak |
| 3,364,685 | A | 1/1968 | Perret |
| 3,645,106 | A | 2/1972 | Gaumer, Jr. et al. |
| 3,729,945 | A | 5/1973 | Linnett |
| 4,033,735 | A | 7/1977 | Swenson |
| 4,057,972 | A | 11/1977 | Sarsten |
| 4,112,700 | A | 9/1978 | Forg |
| RE30,085 | E | 8/1979 | Perret |
| 4,251,247 | A | 2/1981 | Gauberthier et al. |
| 4,274,849 | A | 6/1981 | Garier et al. |

(Continued)

FOREIGN PATENT DOCUMENTS

| | | | |
|---|---|---|---|
| CN | 202361751 | U | 8/2012 |
| CN | 102748919 | A | 10/2012 |

(Continued)

OTHER PUBLICATIONS

CN 20236175 U—English Machine Translation (Year: 2012).*

(Continued)

*Primary Examiner* — Jenna M Hopkins
(74) *Attorney, Agent, or Firm* — Cook Alex Ltd.

(57) ABSTRACT

Provided are mixed refrigerant systems and methods and, more particularly, to a mixed refrigerant system and methods that provides greater efficiency and reduced power consumption via control of a liquid level in a cold vapor separator device.

17 Claims, 15 Drawing Sheets

(56) References Cited

U.S. PATENT DOCUMENTS 4,504,296 A 3/1985 Newton et al.
4,525,185 A 6/1985 Newton
4,545,795 A 10/1985 Liu et al.
4,586,942 A 5/1986 Gauthier
4,689,063 A 8/1987 Paradowski et al.
4,856,942 A 8/1989 Bernadic et al.
4,901,533 A 2/1990 Fan et al.
5,036,671 A * 8/1991 Nelson ..... F25J 1/0055 62/612
5,329,774 A * 7/1994 Tanguay ..... C07C 7/09 62/335
5,535,594 A 7/1996 Grenier
5,644,931 A * 7/1997 Ueno ..... F28D 9/0093 62/612
5,657,643 A 8/1997 Price
5,718,126 A 2/1998 Capron et al.
5,746,066 A 5/1998 Manley
5,768,912 A 6/1998 Dubar
5,791,160 A * 8/1998 Mandler ..... F25J 1/0245 62/611
5,813,250 A 9/1998 Ueno et al.
5,950,450 A 9/1999 Meyer et al.
6,041,619 A 3/2000 Fischer et al.
6,065,305 A 5/2000 Arman et al.
6,250,105 B1 6/2001 Kimble
6,253,574 B1 * 7/2001 Stockmann ..... F25J 1/0022 62/612
6,269,655 B1 8/2001 Roberts et al.
6,289,692 B1 9/2001 Houser et al.
6,295,833 B1 10/2001 Hoffart et al.
6,298,688 B1 * 10/2001 Brostow ..... F25J 1/0012 62/613
6,308,531 B1 10/2001 Robert et al.
6,324,867 B1 12/2001 Fanning et al.
6,334,334 B1 1/2002 Stockmann et al.
6,347,531 B1 * 2/2002 Roberts ..... F25J 1/0055 62/612
6,347,532 B1 2/2002 Agrawal et al.
6,367,286 B1 4/2002 Price
6,378,330 B1 4/2002 Minta et al.
6,389,844 B1 5/2002 Klein Nagel Voort
6,449,984 B1 9/2002 Paradowski
6,530,240 B1 3/2003 Kountz et al.
6,622,518 B2 9/2003 Park
6,694,774 B1 2/2004 Rashad et al.
6,725,688 B2 * 4/2004 Elion ..... F25J 1/0272 62/612
6,742,357 B1 6/2004 Roberts
7,082,787 B2 8/2006 Lee et al.
7,086,251 B2 8/2006 Roberts
7,127,914 B2 10/2006 Roberts et al.
7,213,413 B2 * 5/2007 Battiste ..... F25J 3/0209 356/301
7,308,805 B2 12/2007 Roberts
7,310,971 B2 12/2007 Eaton et al.
7,415,840 B2 8/2008 Eaton et al.
7,565,815 B2 7/2009 Wilkinson et al.
7,591,149 B2 9/2009 Ransbarger et al.
7,628,035 B2 12/2009 Paradowski
7,673,476 B2 3/2010 Whitesell
8,020,406 B2 9/2011 Vandor et al.
8,117,852 B2 2/2012 Mak
8,181,481 B2 5/2012 Jager
8,273,152 B2 9/2012 Schwartz et al.
8,312,734 B2 11/2012 Lewis
8,418,481 B2 4/2013 Minor et al.
8,424,340 B2 4/2013 Eaton et al.
8,434,325 B2 5/2013 Martinez et al.
8,438,874 B2 5/2013 Koganezawa et al.
8,464,551 B2 6/2013 Roberts et al.
9,441,877 B2 * 9/2016 Gushanas ..... F25J 1/0022
9,574,822 B2 * 2/2017 Haberberger ..... F25J 1/0212
9,879,906 B2 * 1/2018 van Aken ..... F25J 1/023
10,345,039 B2 * 7/2019 Gushanas ..... F25J 1/0216
10,480,851 B2 * 11/2019 Ducote, Jr. ..... F25J 1/0291
10,619,918 B2 * 4/2020 Ducote, Jr. ..... F25J 1/0279
10,663,221 B2 * 5/2020 Ducote, Jr. ..... F25J 1/0262
2004/0231359 A1 11/2004 Brostow et al.
2005/0198998 A1 9/2005 Lee et al.
2007/0227185 A1 10/2007 Stone et al.
2007/0283718 A1 12/2007 Hulsey et al.
2008/0016910 A1 1/2008 Brostow et al.
2008/0141711 A1 6/2008 Roberts et al.
2009/0071190 A1 * 3/2009 Potthoff ..... F25J 1/0245 62/614
2009/0205366 A1 * 8/2009 Schmidt ..... F25J 1/0055 62/612
2009/0217701 A1 9/2009 Minta et al.
2009/0241593 A1 10/2009 Jager et al.
2010/0031699 A1 2/2010 Dam et al.
2010/0101272 A1 * 4/2010 Coward ..... F25J 1/0022 62/613
2010/0126215 A1 * 5/2010 Court ..... F25J 1/0055 62/617
2010/0147024 A1 6/2010 Roberts et al.
2010/0154469 A1 6/2010 Eaton et al.
2010/0186445 A1 7/2010 Minta et al.
2010/0186929 A1 7/2010 Chantant et al.
2010/0281915 A1 11/2010 Roberts et al.
2011/0168377 A1 * 7/2011 Alers ..... F25J 1/0248 165/200
2011/0185767 A1 8/2011 Jager et al.
2011/0219819 A1 * 9/2011 Bauer ..... F25J 1/0055 62/612
2011/0226008 A1 * 9/2011 Gushanas ..... F25J 1/0216 62/613
2012/0047943 A1 3/2012 Barclay et al.
2012/0067080 A1 3/2012 Byfield et al.
2012/0137726 A1 6/2012 Currence et al.
2013/0008204 A1 1/2013 Kim et al.
2013/0061632 A1 3/2013 Brostow et al.
2013/0072740 A1 3/2013 Hillman
2013/0133362 A1 * 5/2013 Lee ..... F25J 1/0292 62/611
2013/0139544 A1 6/2013 Mak
2013/0213087 A1 8/2013 Currence
2014/0260415 A1 * 9/2014 Ducote, Jr. ..... F25J 1/0291 62/498
2020/0041179 A1 * 2/2020 Ducote, Jr. ..... F25B 41/40
2020/0318872 A1 * 10/2020 Ducote, Jr. ..... F25B 41/31

FOREIGN PATENT DOCUMENTS

DE 19612173 C1 5/1997
DE 19937623 A1 2/2001
DE 10209799 A1 9/2003
DE 102005053267 A1 5/2007
DE 10194530 B4 10/2007
DE 102010011052 A1 9/2011
DE 102011104725 A1 12/2012
EP 0008823 A1 3/1980
EP 0768502 A1 4/1997
EP 0644996 B1 12/1998
EP 0975923 A1 2/2000
EP 1016842 A1 7/2000
EP 1092930 A1 4/2001
EP 1092931 A1 4/2001
EP 1118827 A1 5/2001
EP 1144928 A2 10/2001
EP 0990108 B1 9/2002
EP 1248935 A1 10/2002
EP 1137902 A2 1/2003
EP 1273860 A2 1/2003
EP 1306632 A1 5/2003
EP 1309973 A2 5/2003
EP 1352203 A1 10/2003
EP 1397629 A1 3/2004
EP 1092932 B1 12/2004
EP 1092933 B1 12/2004
EP 1304535 B1 2/2005
EP 1455152 B1 7/2005
EP 1323994 B1 10/2005

(56) References Cited

FOREIGN PATENT DOCUMENTS

| | | | |
|---|---|---|---|
| EP | 1281033 | B1 | 2/2006 |
| EP | 1790926 | A1 | 5/2007 |
| EP | 1881283 | A2 | 1/2008 |
| EP | 2110630 | A2 | 10/2009 |
| EP | 1456589 | B1 | 1/2010 |
| EP | 2199716 | A2 | 6/2010 |
| EP | 1668300 | B1 | 8/2010 |
| EP | 2251625 | A2 | 11/2010 |
| EP | 2562501 | A2 | 2/2013 |
| EP | 1613909 | B1 | 3/2013 |
| EP | 2600088 | A2 | 6/2013 |
| FR | 2764972 | A1 | 12/1998 |
| FR | 2841330 | A1 | 12/2003 |
| FR | 2885679 | A1 | 11/2006 |
| FR | 2891900 | A1 | 4/2007 |
| GB | 248711 | | 3/1927 |
| GB | 1122830 | A | 8/1968 |
| GB | 2326464 | A | 12/1998 |
| GB | 2326465 | A | 12/1998 |
| JP | H8-159652 | A | 6/1996 |
| JP | H9-113129 | A | 5/1997 |
| JP | 2011506894 | A | 3/2001 |
| JP | 2002508055 | A | 3/2002 |
| JP | 2002532674 | A | 10/2002 |
| WO | 9424500 | A1 | 10/1994 |
| WO | 9848227 | A1 | 10/1998 |
| WO | 9859206 | A1 | 12/1998 |
| WO | 0036350 | A2 | 6/2000 |
| WO | 0139200 | A2 | 5/2001 |
| WO | 01044735 | A1 | 6/2001 |
| WO | 0229337 | A1 | 4/2002 |
| WO | 02050483 | A1 | 6/2002 |
| WO | 02101307 | A1 | 12/2002 |
| WO | 03074955 | A1 | 9/2003 |
| WO | 2004083753 | A2 | 9/2004 |
| WO | 2005028976 | A1 | 3/2005 |
| WO | 2006007278 | A2 | 1/2006 |
| WO | 2006009610 | A2 | 1/2006 |
| WO | 2006047098 | A2 | 5/2006 |
| WO | 2006094675 | A1 | 9/2006 |
| WO | 2006120127 | A2 | 11/2006 |
| WO | 2007021351 | A1 | 2/2007 |
| WO | 2007042662 | A2 | 4/2007 |
| WO | 2007120782 | A2 | 10/2007 |
| WO | 2008006867 | A2 | 1/2008 |
| WO | 2008009721 | A2 | 1/2008 |
| WO | 2008020044 | A2 | 2/2008 |
| WO | 2008034875 | A2 | 3/2008 |
| WO | 2008074718 | A2 | 6/2008 |
| WO | 2009007435 | A2 | 1/2009 |
| WO | 2009029140 | A1 | 3/2009 |
| WO | 2009050178 | A2 | 4/2009 |
| WO | 2009061777 | A1 | 5/2009 |
| WO | 2009072900 | A1 | 6/2009 |
| WO | 2009085937 | A1 | 7/2009 |
| WO | 2010058277 | A2 | 5/2010 |
| WO | 2010096223 | A1 | 8/2010 |
| WO | 2010096305 | A1 | 8/2010 |
| WO | 2010133482 | A2 | 11/2010 |
| WO | 2011115760 | A1 | 9/2011 |
| WO | 2011117655 | A2 | 9/2011 |
| WO | 2012023752 | A2 | 2/2012 |
| WO | 2012075266 | A2 | 6/2012 |
| WO | 2012112692 | A1 | 8/2012 |
| WO | 2012167007 | A1 | 12/2012 |
| WO | 2013055305 | A1 | 4/2013 |
| WO | 013087571 | A2 | 6/2013 |
| WO | 2013081979 | A1 | 6/2013 |
| WO | 2013087570 | A2 | 6/2013 |
| WO | 2014116363 | A1 | 7/2014 |

OTHER PUBLICATIONS

International Search Report and Written Opinion issued for International Application No. PCT/US2011/027162, dated May 3, 2011 (10 Pages).

International Preliminary Report on Patentability for International Application No. PCT/US2011/027162, dated Sep. 18, 2012 (8 pages).

International Search Report and Written Opinion from the International Bureau for International Application No. PCT/US2014/031135, dated Aug. 19, 2014 (9 pages).

International Preliminary Report on Patentability from the International Bureau for International Application No. PCT/US2014/031135, dated Mar. 9, 2015 (25 pages).

Office Action issued in Mexican Application No. MX/a/2012/010726, dated Mar. 12, 2015 with English translation (9 pages).

Supplementary European Search Report issued in EP11756720, dated Jun. 1, 2015 (8 pages).

International Search Report and Written Opinion of the International Searching Authority, PCT/US2016/026924, dated Aug. 19, 2016 (11 pages).

Extended European Search Report from the European Patent Office for European Application No. EP 14762447.2, dated Jun. 19, 2017 (14 pages).

Notification of Reasons for Rejection from the Third Examination Department of the Japanese Patent Office for Japanese Patent Application No. 2016-502613, dated Jun. 20, 2018 with English translation (15 pages).

* cited by examiner

MIXED REFRIGERANT SYSTEM AND METHOD

RELATED APPLICATIONS

This application is a continuation-in-part of U.S. patent application Ser. No. 14/218,949, filed Mar. 18, 2014, which claims priority to U.S. Provisional Patent Application No. 61/802,350, filed Mar. 15, 2013, the entire contents of each of which are hereby incorporated by reference.

FIELD OF THE INVENTION

The present invention generally relates to mixed refrigerant systems and methods suitable for cooling fluids such as natural gas.

BACKGROUND

Natural gas and other gases are liquefied for storage and transport. Liquefaction reduces the volume of the gas and is typically carried out by chilling the gas through indirect heat exchange in one or more refrigeration cycles. The refrigeration cycles are costly because of the complexity of the equipment and the performance efficiency of the cycle. There is a need, therefore, for gas cooling and/or liquefaction systems that are less complex, more efficient, and less expensive to operate.

Liquefying natural gas, which is primarily methane, typically requires cooling the gas stream to approximately −160° C. to −170° C. and then letting down the pressure to approximately atmospheric. Typical temperature-enthalpy curves for liquefying gaseous methane, such as shown in FIG. 1 (methane at 60 bar pressure, methane at 35 bar pressure, and a methane/ethane mixture at 35 bar pressure), have three regions along an S-shaped curve. As the gas is cooled, at temperatures above about −75° C. the gas is de-superheating; and at temperatures below about −90° C. the liquid is subcooling. Between these temperatures, a relatively flat region is observed in which the gas is condensing into liquid. In the 60 bar methane curve, because the gas is above the critical pressure, only one phase is present above the critical temperature, but its specific heat is large near the critical temperature; below the critical temperature the cooling curve is similar to the lower pressure (35 bar) curves. The 35 bar curve for 95% methane/5% ethane shows the effect of impurities, which round off the dew and bubble points.

Refrigeration processes supply the requisite cooling for liquefying natural gas, and the most efficient of these have heating curves that closely approach the cooling curves in FIG. 1, ideally to within a few degrees throughout the entire temperature range. However, because of the S-shaped form of the cooling curves and the large temperature range, such refrigeration processes are difficult to design. Pure component refrigerant processes, because of their flat vaporization curves, work best in the two-phase region. Multi-component refrigerant processes, on the other hand, have sloping vaporization curves and are more appropriate for the de-superheating and subcooling regions. Both types of processes, and hybrids of the two, have been developed for liquefying natural gas.

Cascaded, multilevel, pure component refrigeration cycles were initially used with refrigerants such as propylene, ethylene, methane, and nitrogen. With enough levels, such cycles can generate a net heating curve that approximates the cooling curves shown in FIG. 1. However, as the number of levels increases, additional compressor trains are required, which undesirably adds to the mechanical complexity. Further, such processes are thermodynamically inefficient because the pure component refrigerants vaporize at constant temperature instead of following the natural gas cooling curve, and the refrigeration valve irreversibly flashes the liquid into vapor. For these reasons, mixed refrigerant processes have become popular to reduce capital costs and energy consumption and to improve operability.

U.S. Pat. No. 5,746,066 to Manley describes a cascaded, multilevel, mixed refrigerant process for ethylene recovery, which eliminates the thermodynamic inefficiencies of the cascaded multilevel pure component process. This is because the refrigerants vaporize at rising temperatures following the gas cooling curve, and the liquid refrigerant is subcooled before flashing thus reducing thermodynamic irreversibility. Mechanical complexity is somewhat reduced because fewer refrigerant cycles are required compared to pure refrigerant processes. See, e.g., U.S. Pat. No. 4,525,185 to Newton; U.S. Pat. No. 4,545,795 to Liu et al.; U.S. Pat. No. 4,689,063 to Paradowski et al.; and U.S. Pat. No. 6,041,619 to Fischer et al.; and U.S. Patent Application Publication Nos. 2007/0227185 to Stone et al. and 2007/0283718 to Hulsey et al.

The cascaded, multilevel, mixed refrigerant process is among the most efficient known, but a simpler, more efficient process, which can be more easily operated, is desirable.

A single mixed refrigerant process, which requires only one compressor for refrigeration and which further reduces the mechanical complexity has been developed. See, e.g., U.S. Pat. No. 4,033,735 to Swenson. However, for primarily two reasons, this process consumes somewhat more power than the cascaded, multilevel, mixed refrigerant processes discussed above.

First, it is difficult, if not impossible, to find a single mixed refrigerant composition that generates a net heating curve that closely approximates the typical natural gas cooling curve. Such a refrigerant requires a range of relatively high and low boiling components, whose boiling temperatures are thermodynamically constrained by the phase equilibrium. Higher boiling components are further limited in order to avoid their freezing out at low temperatures. The undesirable result is that relatively large temperature differences necessarily occur at several points in the cooling process, which is inefficient in the context of power consumption.

Second, in single mixed refrigerant processes, all of the refrigerant components are carried to the lowest temperature even though the higher boiling components provide refrigeration only at the warmer end of the process. The undesirable result is that energy must be expended to cool and reheat those components that are "inert" at the lower temperatures. This is not the case with either the cascaded, multilevel, pure component refrigeration process or the cascaded, multilevel, mixed refrigerant process.

To mitigate this second inefficiency and also address the first, numerous solutions have been developed that separate a heavier fraction from a single mixed refrigerant, use the heavier fraction at the higher temperature levels of refrigeration, and then recombine the heavier fraction with the lighter fraction for subsequent compression. See, e.g., U.S. Pat. No. 2,041,725 to Podbielniak; U.S. Pat. No. 3,364,685 to Perret; U.S. Pat. No. 4,057,972 to Sarsten; U.S. Pat. No. 4,274,849 to Garrier et al.; U.S. Pat. No. 4,901,533 to Fan et al.; U.S. Pat. No. 5,644,931 to Ueno et al.; U.S. Pat. No. 5,813,250 to Ueno et al; U.S. Pat. No. 6,065,305 to Arman et al.; and U.S. Pat. No. 6,347,531 to Roberts et al.; and U.S.

Patent Application Publication No. 2009/0205366 to Schmidt. With careful design, these processes can improve energy efficiency even though the recombining of streams not at equilibrium is thermodynamically inefficient. This is because the light and heavy fractions are separated at high pressure and then recombined at low pressure so that they may be compressed together in a single compressor. Generally, when streams are separated at equilibrium, separately processed, and then recombined at non-equilibrium conditions, a thermodynamic loss occurs, which ultimately increases power consumption. Therefore the number of such separations should be minimized. All of these processes use simple vapor/liquid equilibrium at various places in the refrigeration process to separate a heavier fraction from a lighter one.

Simple one-stage vapor/liquid equilibrium separation, however, doesn't concentrate the fractions as much as using multiple equilibrium stages with reflux. Greater concentration allows greater precision in isolating a composition that provides refrigeration over a specific range of temperatures. This enhances the process ability to follow the typical gas cooling curves. U.S. Pat. No. 4,586,942 to Gauthier and U.S. Pat. No. 6,334,334 to Stockmann et al. (the latter marketed by Linde as the LIMIUM® 3 process) describe how fractionation may be employed in the above ambient compressor train to further concentrate the separated fractions used for refrigeration in different temperature zones and thus improve the overall process thermodynamic efficiency. A second reason for concentrating the fractions and reducing their temperature range of vaporization is to ensure that they are completely vaporized when they leave the refrigerated part of the process. This fully utilizes the latent heat of the refrigerant and precludes the entrainment of liquids into downstream compressors. For this same reason heavy fraction liquids are normally re-injected into the lighter fraction of the refrigerant as part of the process. Fractionation of the heavy fractions reduces flashing upon re-injection and improves the mechanical distribution of the two phase fluids.

As illustrated by U.S. Patent Application Publication No. 2007/0227185 to Stone et al., it is known to remove partially vaporized refrigeration streams from the refrigerated portion of the process. Stone et al. does this for mechanical (and not thermodynamic) reasons and in the context of a cascaded, multilevel, mixed refrigerant process that requires two separate mixed refrigerants. The partially vaporized refrigeration streams are completely vaporized upon recombination with their previously separated vapor fractions immediately prior to compression.

Multi-stream, mixed refrigerant systems are known in which simple equilibrium separation of a heavy fraction was found to significantly improve the mixed refrigerant process efficiency if that heavy fraction isn't entirely vaporized as it leaves the primary heat exchanger. See, e.g., U.S. Patent Application Publication No. 2011/0226008 to Gushanas et al. Liquid refrigerant, if present at the compressor suction, must be separated beforehand and sometimes pumped to a higher pressure. When the liquid refrigerant is mixed with the vaporized lighter fraction of the refrigerant, the compressor suction gas is cooled, which further reduces the power required. Heavy components of the refrigerant are kept out of the cold end of the heat exchanger, which reduces the possibility of refrigerant freezing. Also, equilibrium separation of the heavy fraction during an intermediate stage reduces the load on the second or higher stage compressor(s), which improves process efficiency. Use of the heavy fraction in an independent pre-cool refrigeration loop can result in a near closure of the heating/cooling curves at the warm end of the heat exchanger, which results in more efficient refrigeration.

"Cold vapor" separation has been used to fractionate high pressure vapor into liquid and vapor streams. See, e.g., U.S. Pat. No. 6,334,334 to Stockmann et al., discussed above; "State of the Art LNG Technology in China", Lange, M., 5$^{th}$ Asia LNG Summit, Oct. 14, 2010; "Cryogenic Mixed Refrigerant Processes", International Cryogenics Monograph Series, Venkatarathnam, G., Springer, pp 199-205; and "Efficiency of Mid Scale LNG Processes Under Different Operating Conditions", Bauer, H., Linde Engineering. In another process, marketed by Air Products as the AP-SMR™ LNG process, a "warm", mixed refrigerant vapor is separated into cold mixed refrigerant liquid and vapor streams. See, e.g., "Innovations in Natural Gas Liquefaction Technology for Future LNG Plants and Floating LNG Facilities", International Gas Union Research Conference 2011, Bukowski, J. et al. In these processes, the thus-separated cold liquid is used as the middle temperature refrigerant by itself and remains separate from the thus-separated cold vapor prior to joining a common return stream. The cold liquid and vapor streams, together with the rest of the returning refrigerants, are recombined via cascade and exit together from the bottom of the heat exchanger.

In the vapor separation systems discussed above, the warm temperature refrigeration used to partially condense the liquid in the cold vapor separator is produced by the liquid from the high-pressure accumulator. The present inventors have found that this requires higher pressure and less than ideal temperatures, both of which undesirably consume more power during operation.

Another process that uses cold vapor separation, albeit in a multi-stage, mixed refrigerant system, is described in GB Pat. No. 2,326,464 to Costain Oil. In this system, vapor from a separate reflux heat exchanger is partially condensed and separated into liquid and vapor streams. The thus-separated liquid and vapor streams are cooled and separately flashed before rejoining in a low-pressure return stream. Then, before exiting the main heat exchanger, the low-pressure return stream is combined with a subcooled and flashed liquid from the aforementioned reflux heat exchanger and then further combined with a subcooled and flashed liquid provided by a separation drum set between the compressor stages. In this system, the "cold vapor" separated liquid and the liquid from the aforementioned reflux heat exchanger are not combined prior to joining the low-pressure return stream. That is, they remain separate before independently joining up with the low-pressure return stream. As will be explained more fully below, the present inventors have found that power consumption can be significantly reduced by, inter alia, mixing a liquid obtained from a high-pressure accumulator with the cold vapor separated liquid prior to their joining a return stream.

Figure 6:
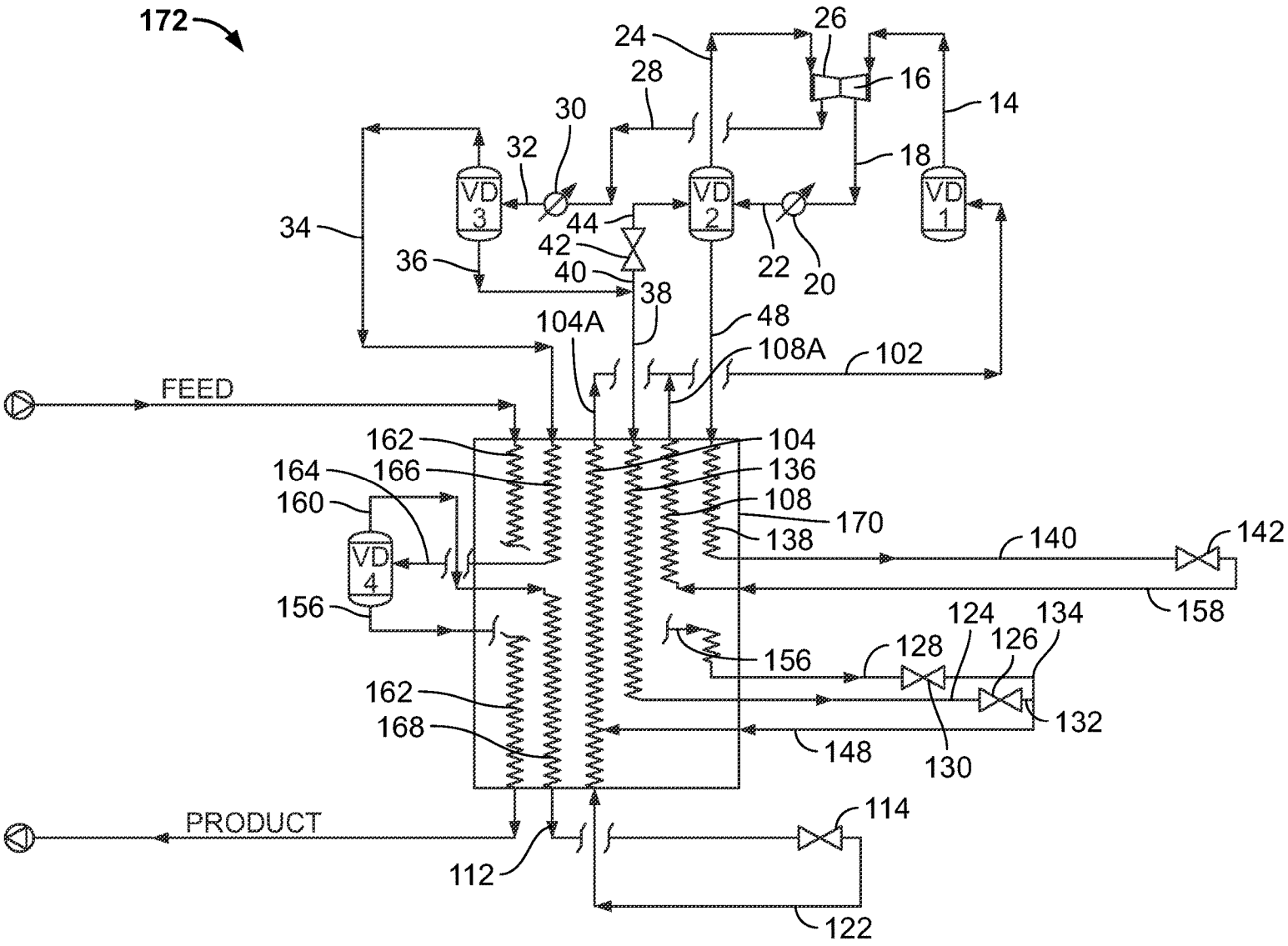
FIG. 6 is a process flow diagram and schematic illustrating a fifth embodiment of a process and system of the invention.
Figure 7:
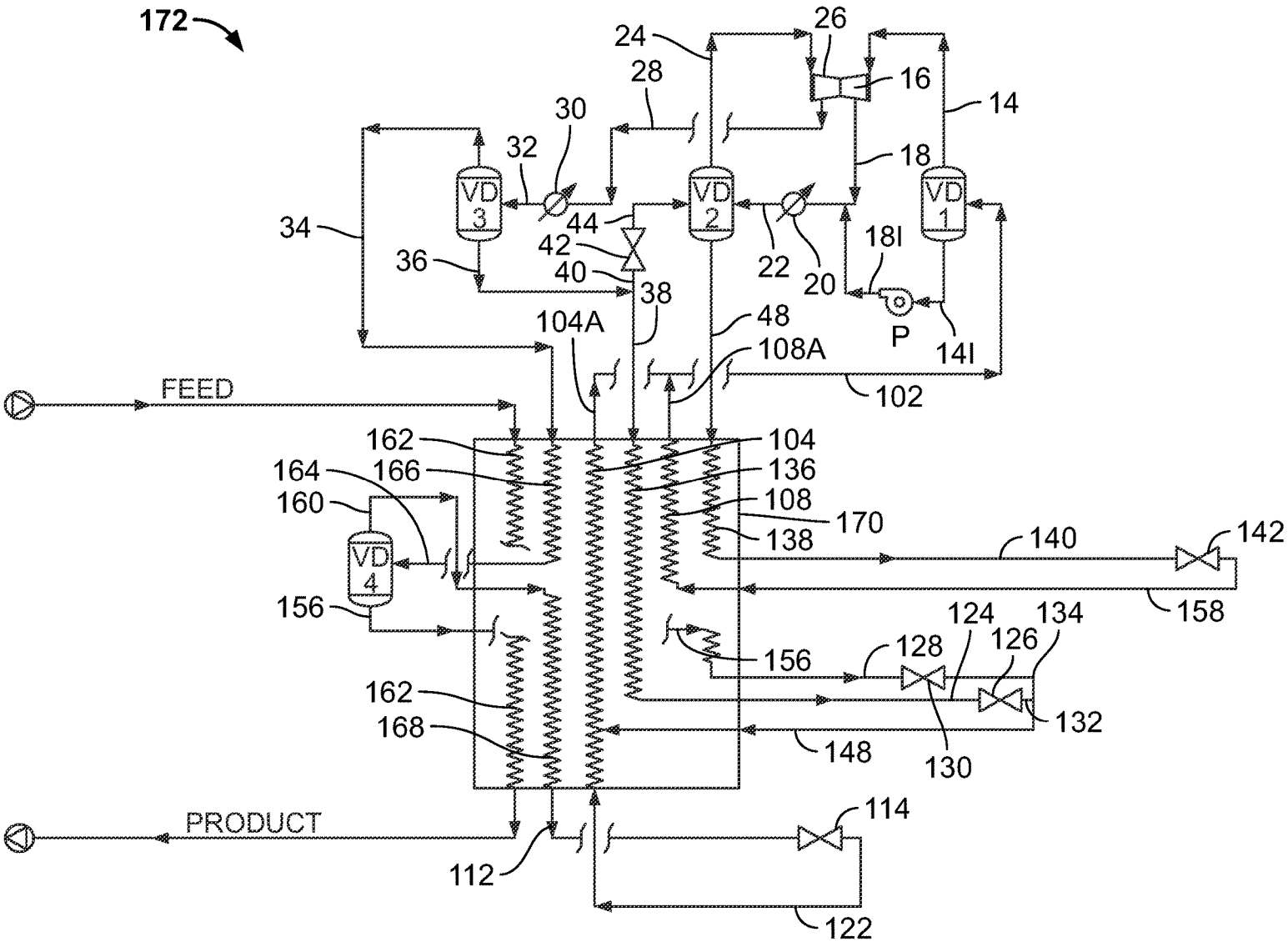
FIG. 7 is a process flow diagram and schematic illustrating a sixth embodiment of a process and system of the invention.

Tables 1 and 2 show stream data for several embodiments of the invention and correlate with FIGS. 6 and 7, respectively.

BRIEF SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a system for cooling a fluid with a mixed refrigerant includes a heat exchanger featuring a feed fluid cooling passage having an inlet configured to receive a fluid feed stream and an outlet through which a cooled fluid stream exits the feed fluid cooling passage. The heat exchanger also includes a primary refrigeration passage, a high pressure liquid passage, a high pressure vapor passage, a cold separator vapor passage and a cold separator liquid passage. A mixed refrigerant compression system includes (i) a first stage compressor configured to receive fluid from the primary refrigeration passage, (ii) a first stage aftercooler configured to receive compressed fluid from the first stage compressor and (iii) a high pressure accumulator having an inlet in fluid communication with the first stage aftercooler, a vapor outlet configured to provide vapor to the high pressure vapor passage of the heat exchanger and a liquid outlet configured to provide liquid to the high pressure liquid passage of the heat exchanger. A cold vapor separator is configured to receive fluid from the high pressure vapor passage of the heat exchanger. The cold vapor separator also has a cold separator vapor outlet configured to direct vapor to the cold separator vapor passage of the heat exchanger and a cold separator liquid outlet configured to direct liquid to the cold separator liquid passage of the heat exchanger. A cold vapor expansion device is configured to receive fluid from the cold separator vapor passage of the heat exchanger. The cold vapor expansion device features an outlet in fluid communication with the primary refrigeration passage of the heat exchanger. A cold separator liquid expansion device is configured to receive fluid from the cold separator liquid passage of the heat exchanger and has a cold separator liquid expansion device outlet. A high pressure liquid expansion device is configured to receive fluid from the high pressure liquid passage of the heat exchanger and has a high pressure liquid expansion device outlet. The cold separator liquid expansion device outlet and the high pressure liquid expansion device outlet are configured so that fluid streams exiting said cold separator liquid expansion device outlet and said high pressure liquid expansion device outlet are combined to form a middle temperature refrigerant stream that is directed to the primary refrigeration passage. A first temperature sensor is configured to measure a first temperature of a fluid stream exiting the cold vapor separator. A first fluid controller is in communication with the first temperature sensor, receives a predetermined set point temperature and controls a flow rate through the cold separator liquid expansion device or the high pressure liquid expansion device based on the measured first temperature and the predetermined set point temperature.

In another aspect, a process for cooling a fluid with a mixed refrigerant includes the steps of separating a high pressure mixed refrigerant stream to form a high pressure vapor stream and a high pressure liquid stream; cooling the high pressure vapor in a heat exchanger to form a mixed phase cold separator feed stream; separating the mixed phase cold separator feed stream with a cold vapor separator to form a cold separator vapor stream and a cold separator liquid stream; condensing the cold separator vapor stream and flashing to form a cold temperature refrigerant stream; cooling the cold separator liquid stream to form a subcooled cold separator liquid stream; flashing the subcooled cold separator liquid stream using a cold separator liquid expansion device to form a first mixed phase stream; cooling the high pressure liquid stream in the heat exchanger to form a subcooled high pressure liquid stream; flashing the subcooled high pressure liquid stream using a high pressure liquid expansion device to form a second mixed phase stream; combining the first and second mixed phase streams to form a middle temperature refrigerant stream; measuring a temperature of a fluid stream exiting the cold vapor separator; comparing the measured temperature with a set point temperature; controlling a flow rate through the cold separator liquid expansion device or the high pressure liquid expansion device based on the comparison; combining the middle temperature refrigerant stream and the cold temperature refrigerant stream; warming the combined middle temperature refrigerant stream and cold temperature refrigerant stream in the heat exchanger to form a refrigerant return stream; and thermally contacting the feed fluid and the heat exchanger, to form a cooled feed fluid product stream.

DESCRIPTION OF THE SEVERAL EMBODIMENTS

Figure 1:
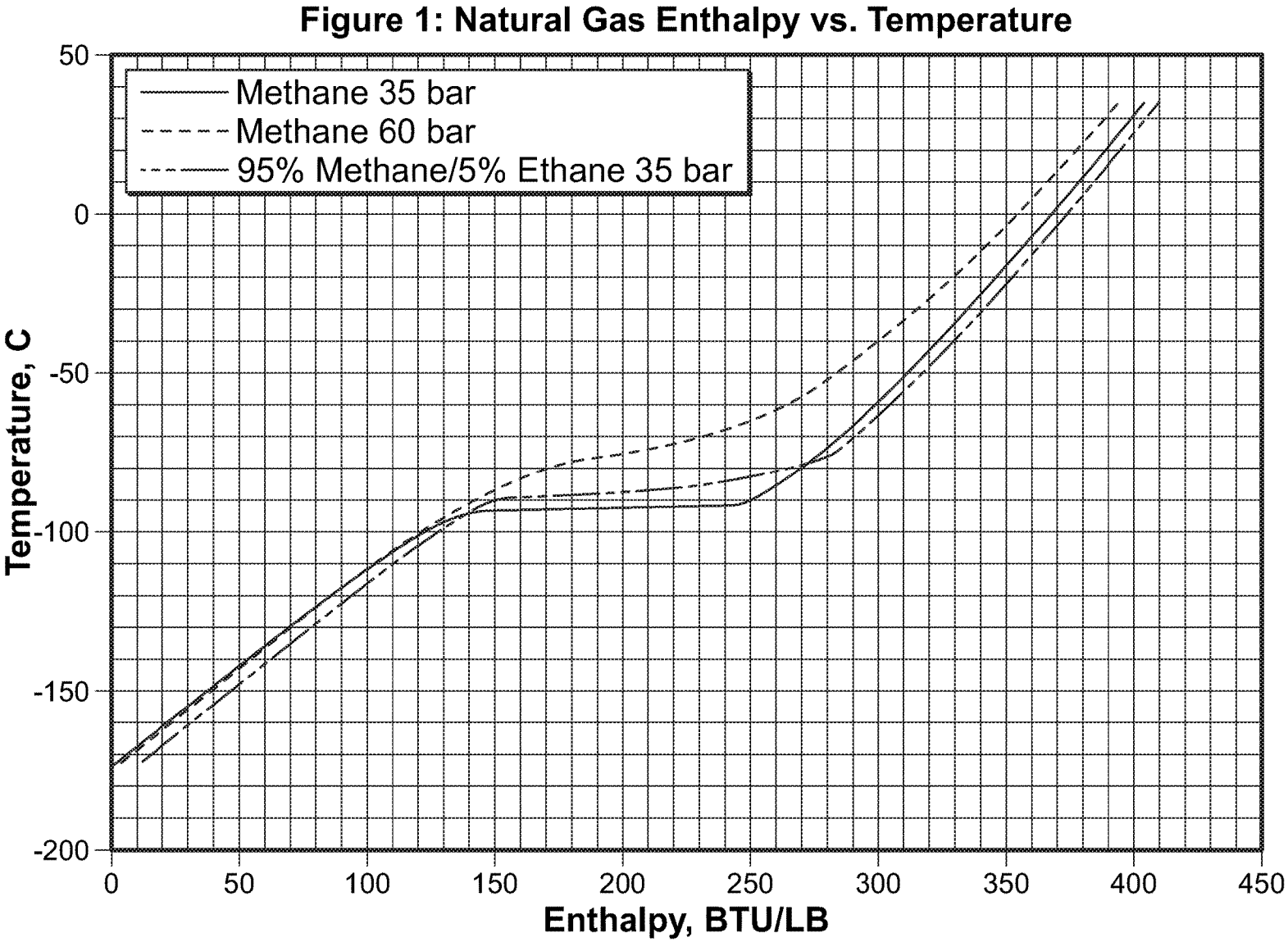
FIG. 1 is a graphical representation of temperature-enthalpy curves for methane and a methane-ethane mixture.
Figure 2:
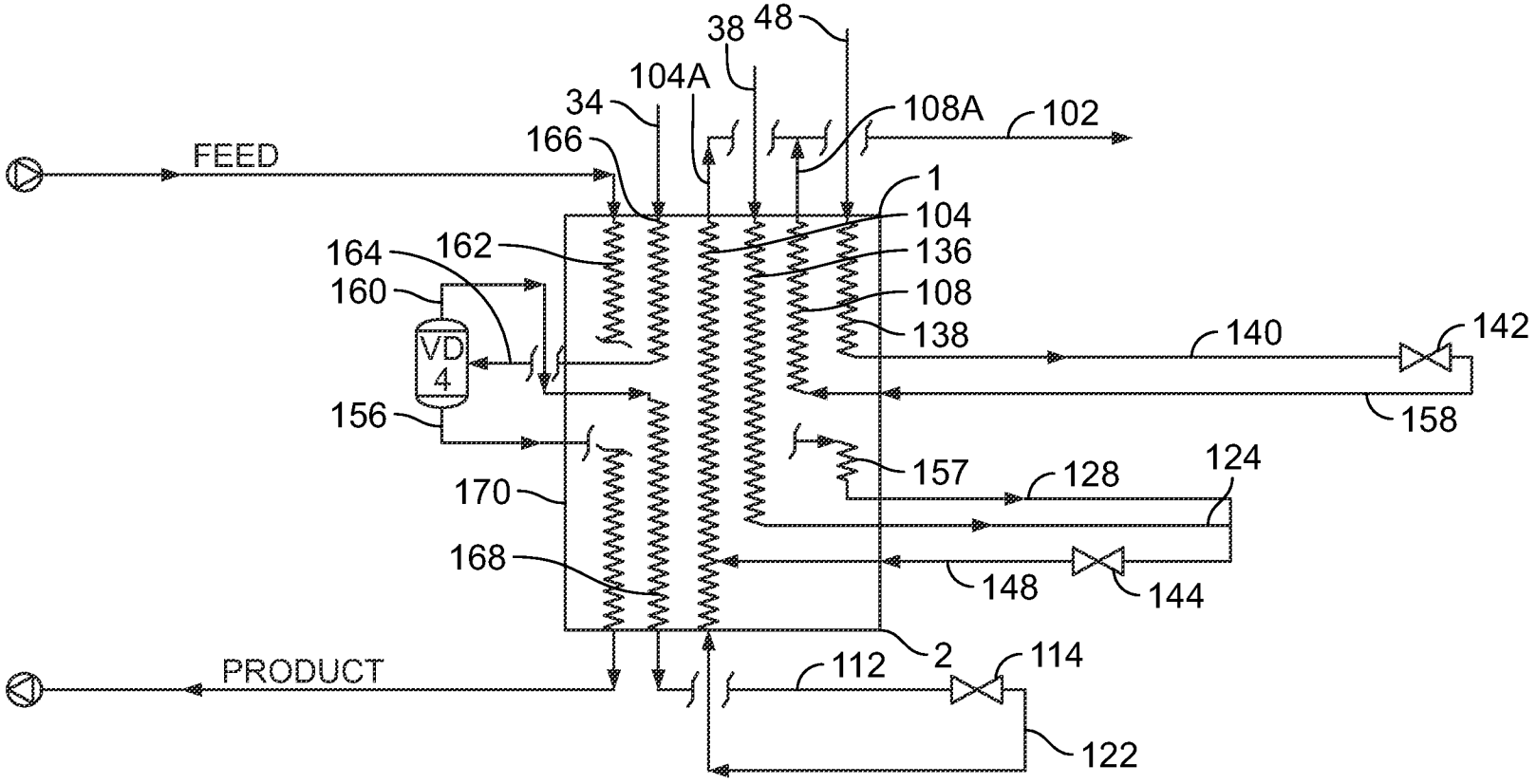
FIG. 2 is a process flow diagram and schematic illustrating an embodiment of a process and system of the invention.

A process flow diagram and schematic illustrating an embodiment of a multi-stream heat exchanger is provided in FIG. 2.

As illustrated in FIG. 2, one embodiment includes a multi-stream heat exchanger 170, having a warm end 1 and a cold end 2. The heat exchanger receives a feed fluid stream, such as a high pressure natural gas feed stream that is cooled and/or liquefied in cooling passage 162 via removal of heat via heat exchange with refrigeration streams in the heat exchanger. As a result, a stream of product fluid such as liquid natural gas is produced. The multi-stream design of the heat exchanger allows for convenient and energy-efficient integration of several streams into a single exchanger. Suitable heat exchangers may be purchased from Chart Energy & Chemicals, Inc. of The Woodlands, Tex. The plate and fin multi-stream heat exchanger available from Chart Energy & Chemicals, Inc. offers the further advantage of being physically compact.

In one embodiment, referring to FIG. 2, a feed fluid cooling passage 162 includes an inlet at the warm end 1 and a product outlet at the cold end 2 through which product exits the feed fluid cooling passage 162. A primary refrigeration passage 104 (or 204—see FIG. 3) has an inlet at the cold end for receiving a cold temperature refrigerant stream 122, a refrigerant return stream outlet at the warm end through which a vapor phase refrigerant return stream 104A exits the primary refrigeration passage 104, and an inlet adapted to receive a middle temperature refrigerant stream 148. In the heat exchanger, at the latter inlet, the primary refrigeration passage 104/204 is joined by the middle temperature refrigerant passage 148, where the cold temperature refrigerant stream 122 and the middle temperature refrigerant stream 148 combine. In one embodiment, the combination of the middle temperature refrigerant stream and the cold temperature refrigerant stream forms a middle temperature zone in the heat exchanger generally from the point at which they combine and downstream from there in the direction of the refrigerant flow toward the primary refrigerant outlet.

It should be noted herein that the passages and streams are sometimes both referred to by the same element number set out in the figures. Also, as used herein, and as known in the art, a heat exchanger is that device or an area in the device wherein indirect heat exchange occurs between two or more streams at different temperatures, or between a stream and the environment. As used herein, the terms "communication", "communicating", and the like generally refer to fluid communication unless otherwise specified. And although two fluids in communication may exchange heat upon mixing, such an exchange would not be considered to be the same as heat exchange in a heat exchanger, although such an exchange can take place in a heat exchanger. A heat exchange system can include those items though not specifically described are generally known in the art to be part of a heat exchanger, such as expansion devices, flash valves, and the like. As used herein, the term "reducing the pressure of" does not involve a phase change, while the term, "flashing", does involve a phase change, including even a partial phase change. As used herein, the terms, "high", "middle", "warm" and the like are relative to comparable streams, as is customary in the art. The stream tables 1 and 2 set out exemplary values as guidance, which are not intended to be limiting unless otherwise specified.

In an embodiment, the heat exchanger includes a high pressure vapor passage 166 adapted to receive a high pressure vapor stream 34 at the warm end and to cool the high pressure vapor stream 34 to form a mixed phase cold separator feed stream 164, and including an outlet in communication with a cold vapor separator VD4, the cold vapor separator VD4 adapted to separate the cold separator feed stream 164 into a cold separator vapor stream 160 and a cold separator liquid stream 156. In one embodiment, the high pressure vapor 34 is received from a high pressure accumulator separation device on the compression side.

In an embodiment, the heat exchanger includes a cold separator vapor passage having an inlet in communication with the cold vapor separator VD4. The cold separator vapor is cooled passage 168 condensed into liquid stream 112, and then flashed with 114 to form the cold temperature refrigerant stream 122. The cold temperature refrigerant 122 then enters the primary refrigeration passage at the cold end thereof. In one embodiment, the cold temperature refrigerant is a mixed phase.

In an embodiment, the cold separator liquid 156 is cooled in passage 157 to form subcooled cold vapor separator liquid 128. This stream can join the subcooled mid-boiling refrigerant liquid 124, discussed below, which, thus combined, are then flashed at 144 to form the middle temperature refrigerant 148, such as shown in FIG. 2. In one embodiment, the middle temperature refrigerant is a mixed phase.

In an embodiment, the heat exchanger includes a high pressure liquid passage 136. In one embodiment, the high pressure liquid passage receives a high pressure liquid 38 from a high pressure accumulator separation device on the compression side. In one embodiment, the high pressure liquid 38 is a mid-boiling refrigerant liquid stream. The high pressure liquid stream enters the warm end and is cooled to form a subcooled refrigerant liquid stream 124. As noted above, the subcooled cold separator liquid stream 128 is combined with the subcooled refrigerant liquid stream 124 to form a middle temperature refrigerant stream 148. In an embodiment, the one or both refrigerant liquids 124 and 128 can independently be flashed at 126 and 130 before combining into the middle temperature refrigerant 148, as shown for example in FIG. 4.

In an embodiment, the cold temperature refrigerant 122 and middle temperature refrigerant 148, thus combined, provide refrigeration in the primary refrigeration passage 104, where they exit as a vapor phase or mixed phase refrigerant return stream 104A/102. In an embodiment, they exit as a vapor phase refrigerant return stream 104A/102. In one embodiment, the vapor is a superheated vapor refrigerant return stream.

As shown in FIG. 2, the heat exchanger may also include a pre-cool passage adapted to receive a high-boiling refrigerant liquid stream 48 at the warm end. In one embodiment, the high-boiling refrigerant liquid stream 48 is provided by an interstage separation device between compressors on the compression side. The high-boiling liquid refrigerant stream 48 is cooled in pre-cool liquid passage 138 to form subcooled high-boiling liquid refrigerant 140. The subcooled high-boiling liquid refrigerant 140 is then flashed or has its pressure reduced at expansion device 142 to form the warm temperature refrigerant stream 158, which may be a mixed vapor liquid phase or liquid phase.

In an embodiment, the warm temperature refrigerant stream 158 enters the pre-cool refrigerant passage 108 to provide cooling. In an embodiment, the pre-cool refrigerant passage 108 provides substantial cooling for the high pressure vapor passage 166, for example, to cool and condense the high pressure vapor 34 into the mixed phase cold separator feed stream 164.

Figure 8:
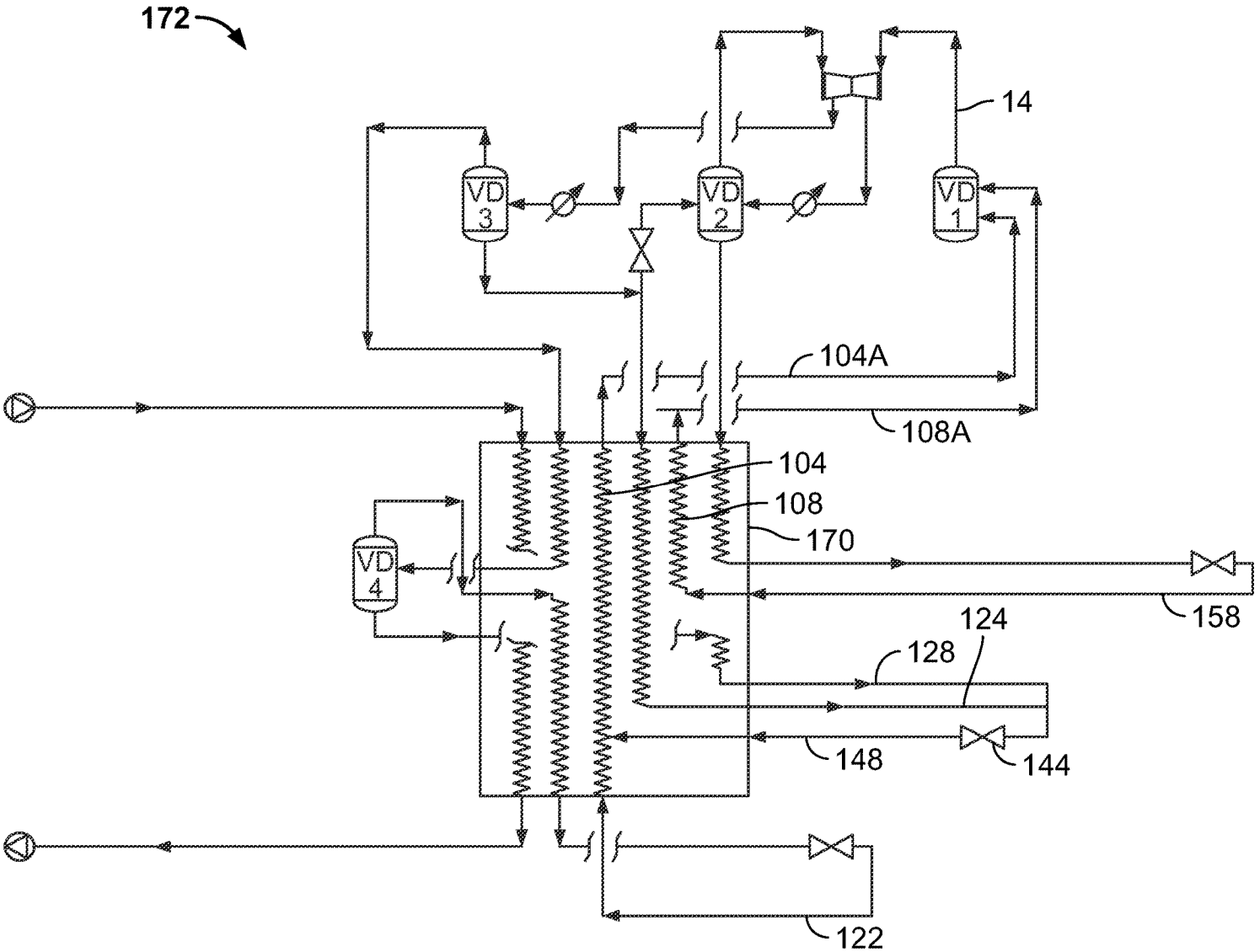
FIG. 8 is a process flow diagram and schematic illustrating a seventh embodiment of a process and system of the invention.

In an embodiment, the warm temperature refrigerant stream exits the pre-cool refrigeration passage 108 as a vapor phase or mixed phase warm temperature refrigerant return stream 108A. In an embodiment, the warm temperature refrigerant return stream 108A returns to the compression side either alone—such as shown in FIG. 8, or in combination with the refrigerant return stream 104A to form return stream 102. If combined, the return streams 108A and 104A can be combined with a mixing device. Examples of non-limiting mixing devices include but are not limited to static mixer, pipe segment, header of the heat exchanger, or combination thereof.

Figure 3:
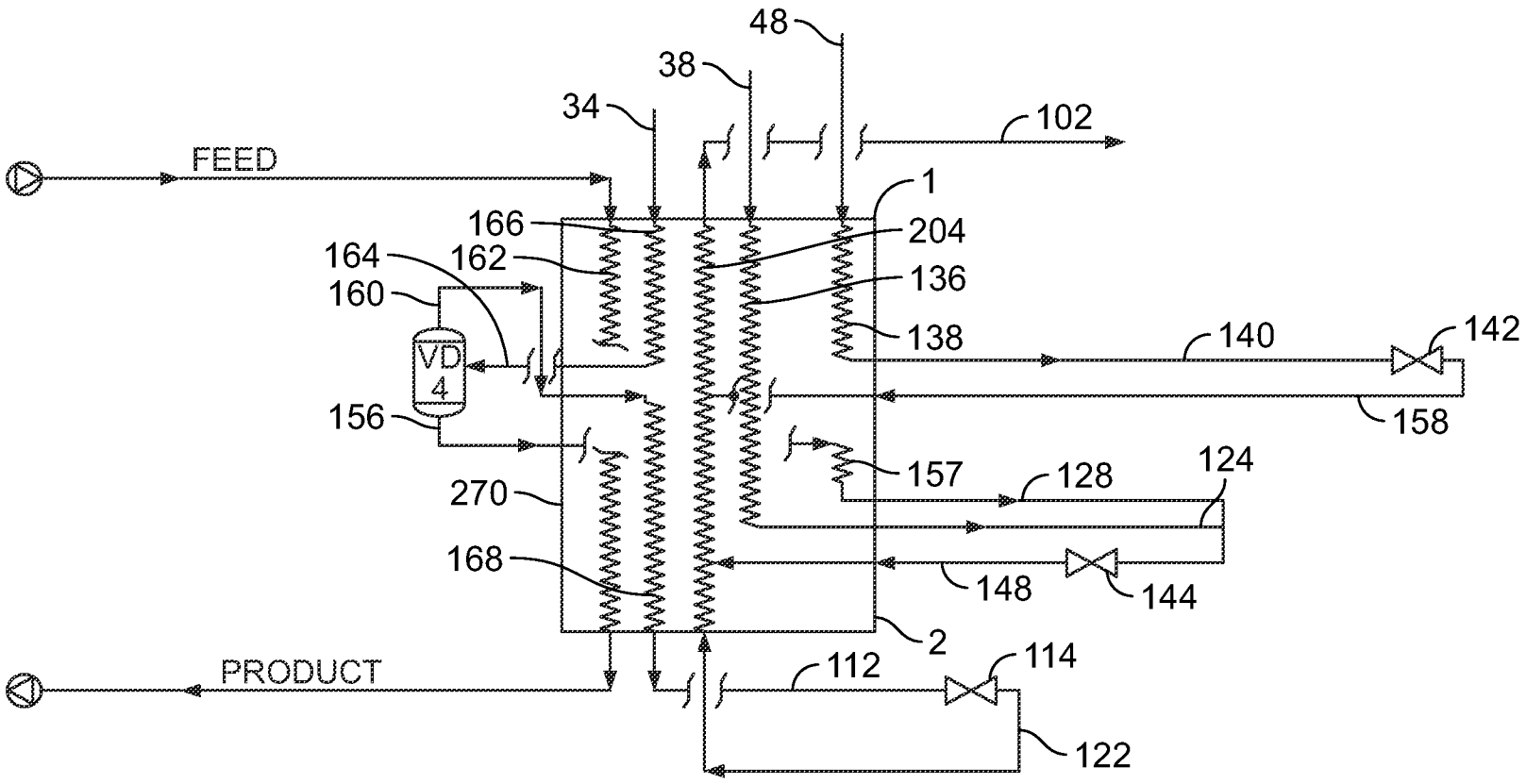
FIG. 3 is a process flow diagram and schematic illustrating a second embodiment of a process and system of the invention.

In an embodiment, the warm temperature refrigerant stream 158, rather than entering the pre-cool refrigerant passage 108, instead is introduced to the primary refrigerant passage 204, such as shown in FIG. 3. The primary refrigerant passage 204 includes an inlet downstream from the point where the middle temperature refrigerant 148 enters the primary refrigerant passage but upstream of the outlet for the return refrigerant stream 202. The cold temperature refrigerant stream 122, which was previously combined with the middle temperature refrigerant stream 148, and the warm temperature refrigerant stream 158 combine to provide warm temperature refrigeration in the corresponding area, e.g., between the refrigerant return stream outlet and the point of introduction of the warm temperature refrigerant 158 in the primary refrigeration passage 204. An example of this is shown in the heat exchanger 270 at FIG. 3. The combined refrigerants 122, 148, and 158 exit as a combined return refrigerant stream 202, which may be a mixed phase or a vapor phase. In an embodiment, the refrigerant return stream from the primary refrigeration passage 204 is a vapor phase return stream 202.

Figure 4:
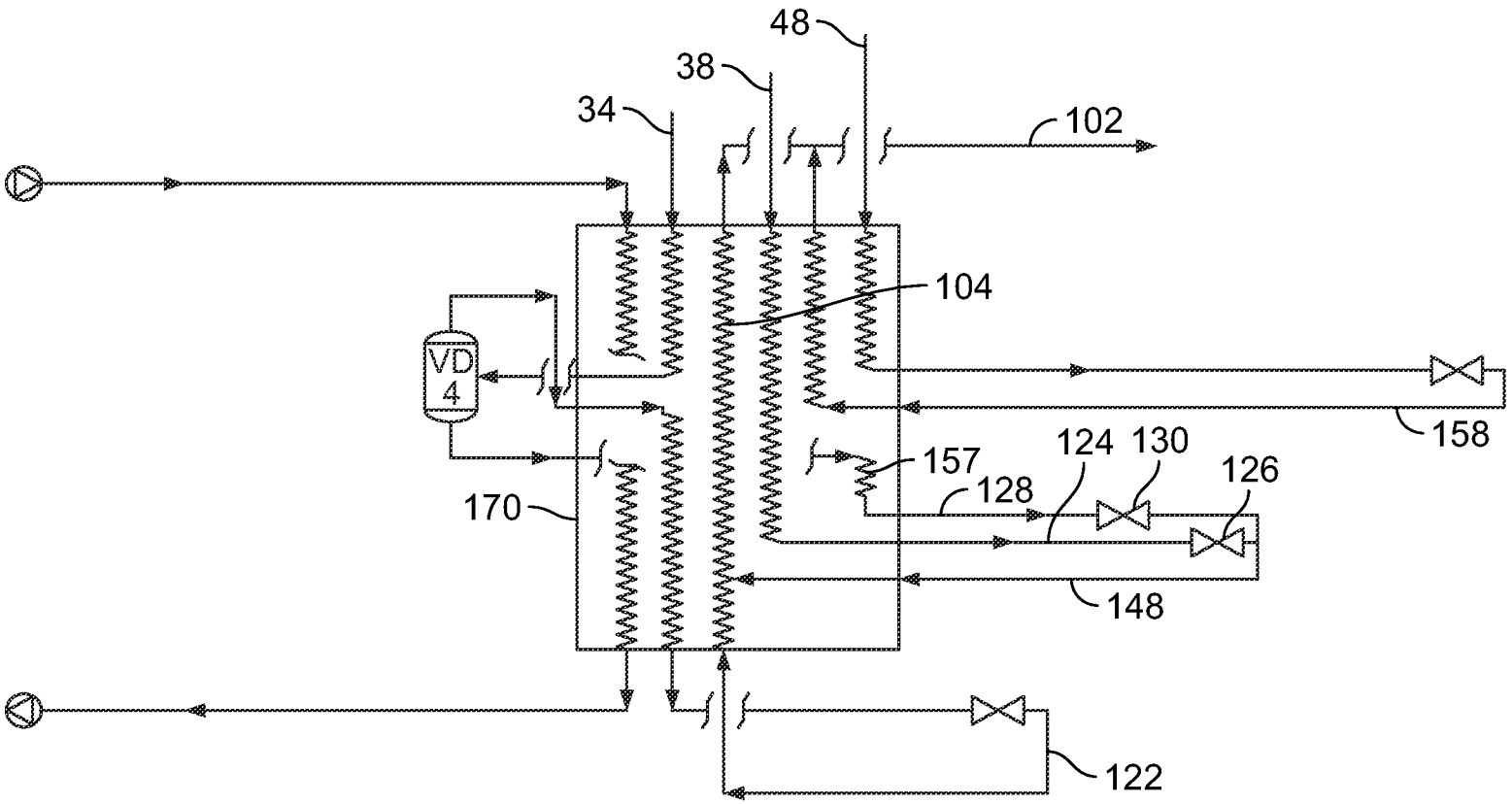
FIG. 4 is a process flow diagram and schematic illustrating a third embodiment of a process and system of the invention.
Figure 5:
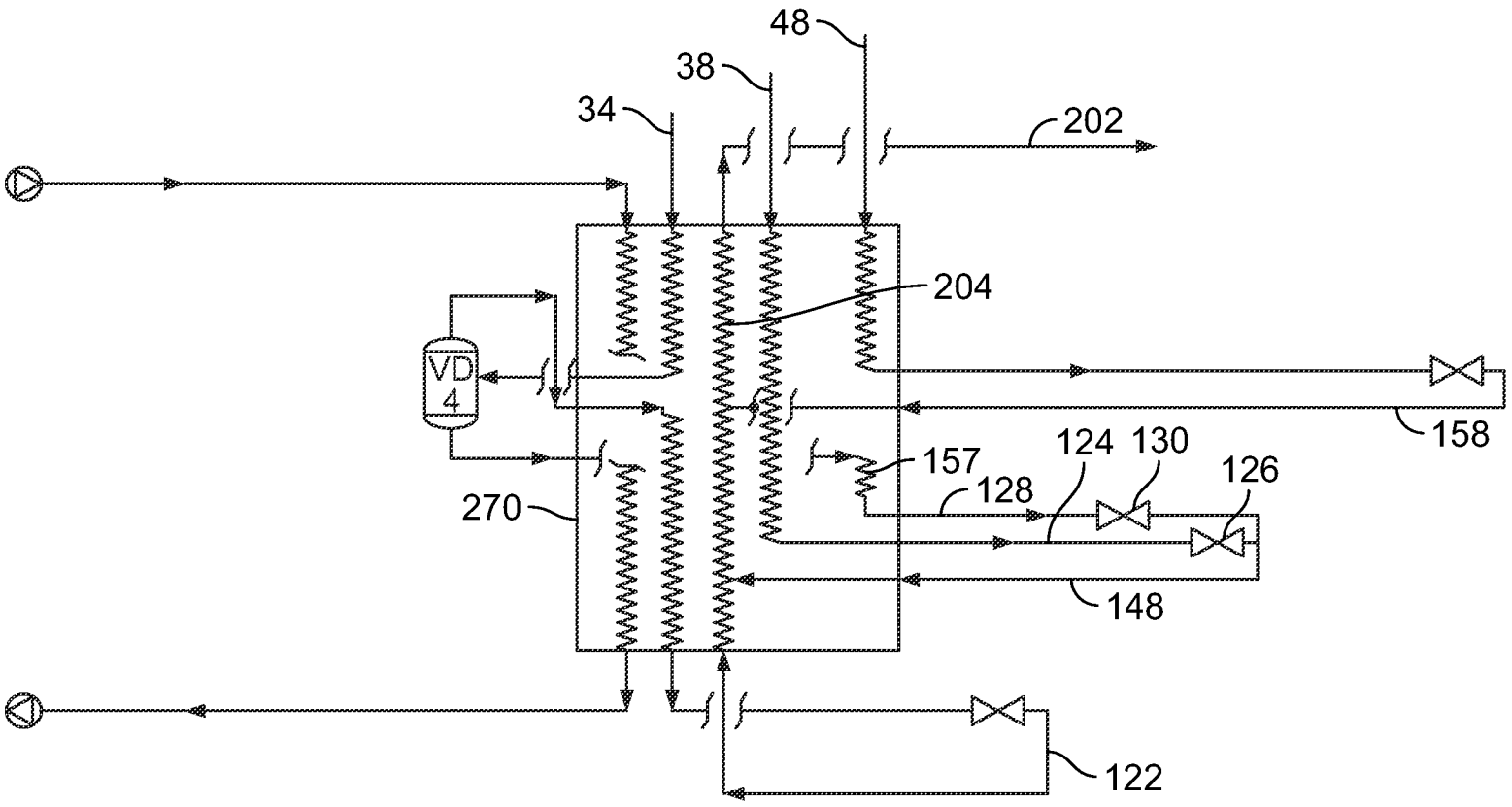
FIG. 5 is a process flow diagram and schematic illustrating a fourth embodiment of a process and system of the invention.

FIG. 5, like FIG. 4 discussed above, shows alternate arrangements for combining the subcooled cold separator liquid stream 128 and subcooled refrigerant liquid stream 124 to form the middle temperature refrigerant stream 148. In an embodiment, the one or both refrigerant liquids 124 and 128 can independently be flashed at 126 and 130 before combining into the middle temperature refrigerant 148.

Referring to FIGS. 6 and 7, in which embodiments of a compression system, generally referenced as 172, are shown in combination with a heat exchanger, exemplified by 170. In an embodiment, the compression system is suitable for circulating a mixed refrigerant in a heat exchanger. Shown is a suction separation device VD1 having an inlet for receiving a low return refrigerant stream 102 (or 202, although not shown) and a vapor outlet and a vapor outlet 14. A compressor 16 is in fluid communication with the vapor outlet 14 and includes a compressed fluid outlet for providing a compressed fluid stream 18. An optional aftercooler 20 is shown for cooling the compressed fluid stream 18. If present, the aftercooler 20 provides a cooled fluid stream 22 to an interstage separation device VD2. The interstage separation device VD2 has a vapor outlet for providing a vapor stream 24 to the second stage compressor 26 and also a liquid outlet for providing a liquid stream 48 to the heat exchanger. In one embodiment the liquid stream 48 is a high-boiling refrigerant liquid stream.

Vapor stream 24 is provided to the compressor 26 via an inlet in communication with the interstage separation device VD2, which compresses the vapor 24 to provide compressed fluid stream 28. An optional aftercooler 30 if present cools the compressed fluid stream 28 to provide an a high pressure mixed phase stream 32 to the accumulator separation device VD3. The accumulator separation device VD3 separates the high pressure mixed phase stream 32 into high pressure vapor stream 34 and a high pressure liquid stream 36, which may be a mid-boiling refrigerant liquid stream. In an embodiment, the high pressure vapor stream 34 is sent to the high pressure vapor passage of the heat exchanger.

An optional splitting intersection is shown, which has an inlet for receiving the mid-high pressure liquid stream 36 from the accumulator separation device VD3, an outlet for providing a mid-boiling refrigerant liquid stream 38 to the heat exchanger, and optionally an outlet for providing a fluid stream 40 back to the interstage separation device VD2. An optional expansion device 42 for stream 40 is shown which, if present provides a an expanded cooled fluid stream 44 to the interstage separation device, the interstage separation device VD2 optionally further comprising an inlet for receiving the fluid stream 44. If the splitting intersection is not present, then the mid-boiling refrigerant liquid stream 36 is in direct fluid communication with mid-boiling refrigerant liquid stream 38.

FIG. 7 further includes an optional pump P, for pumping low pressure liquid refrigerant stream 141, the temperature of which in one embodiment has been lowered by the flash cooling effect of mixing 108A and 104A before suction separation device VD1 for pumping forward to intermediate pressure. As described above, the outlet stream 181 from the pump travels to the interstage drum VD2.

Figure 9:
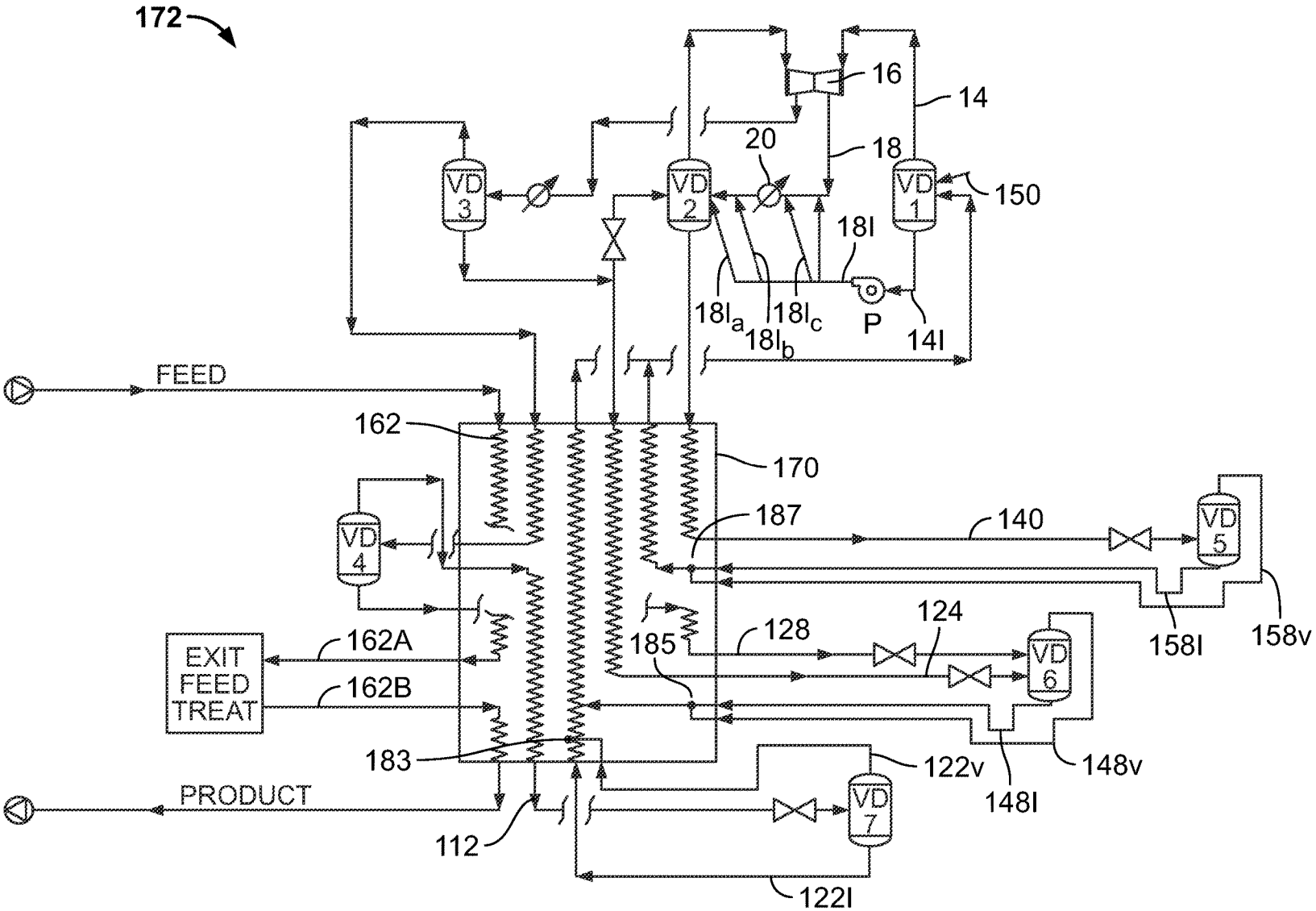
FIG. 9 is a process flow diagram and schematic illustrating an eighth embodiment of a process and system of the invention.
Figure 10:
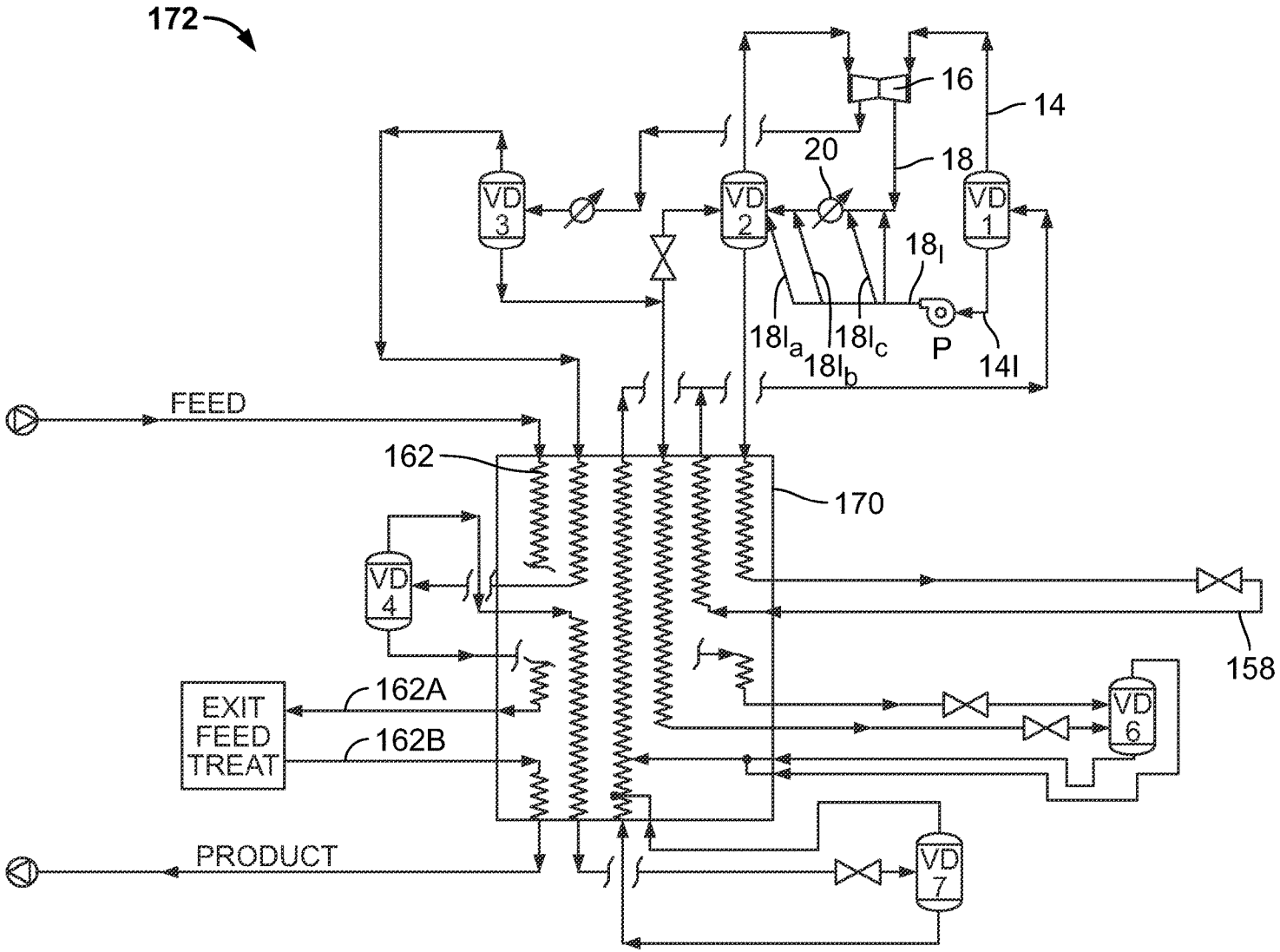
FIG. 10 is a process flow diagram and schematic illustrating a ninth embodiment of a process and system of the invention.
Figure 11:
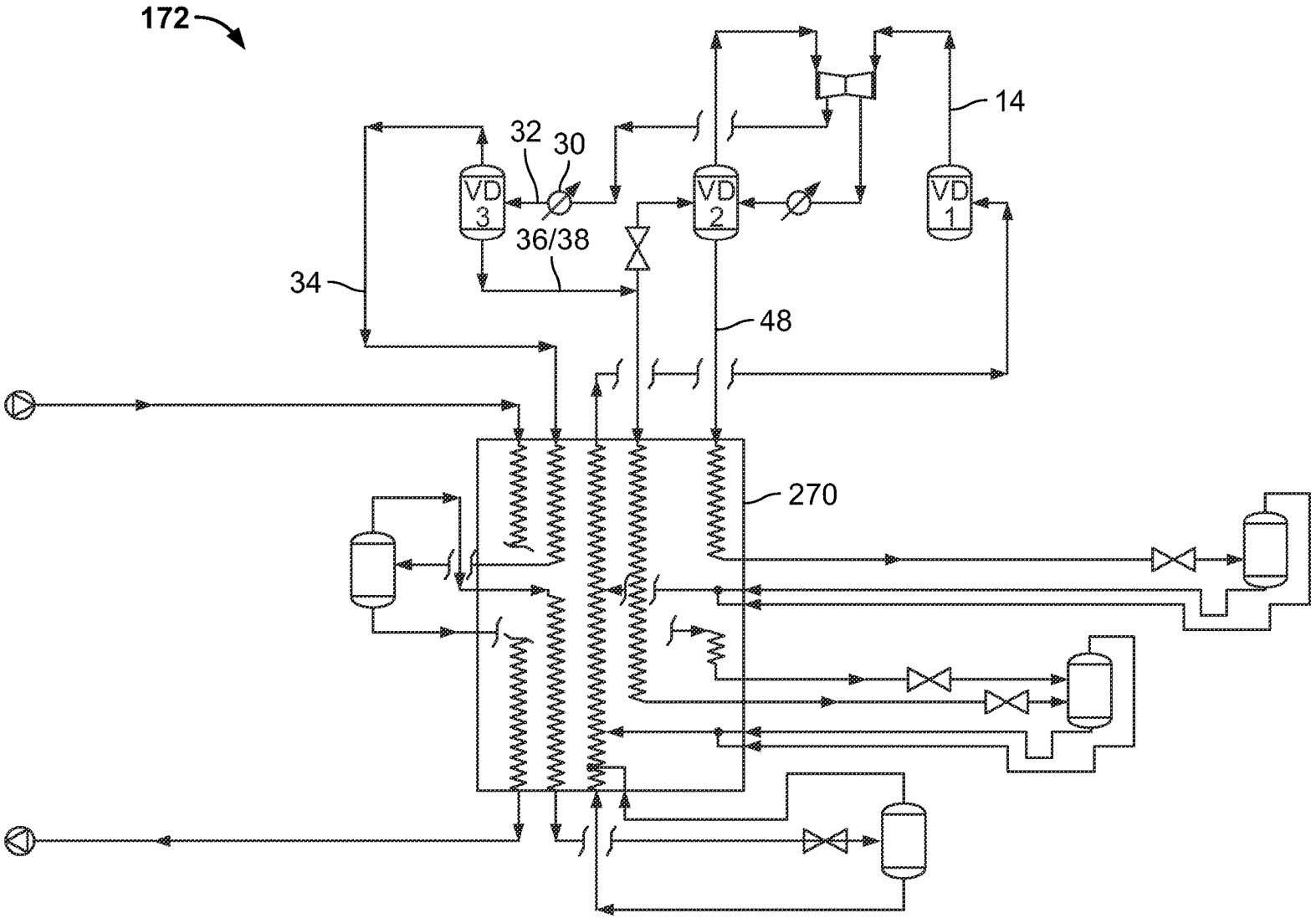
FIG. 11 is a process flow diagram and schematic illustrating a tenth embodiment of a process and system of the invention.
Figure 12:
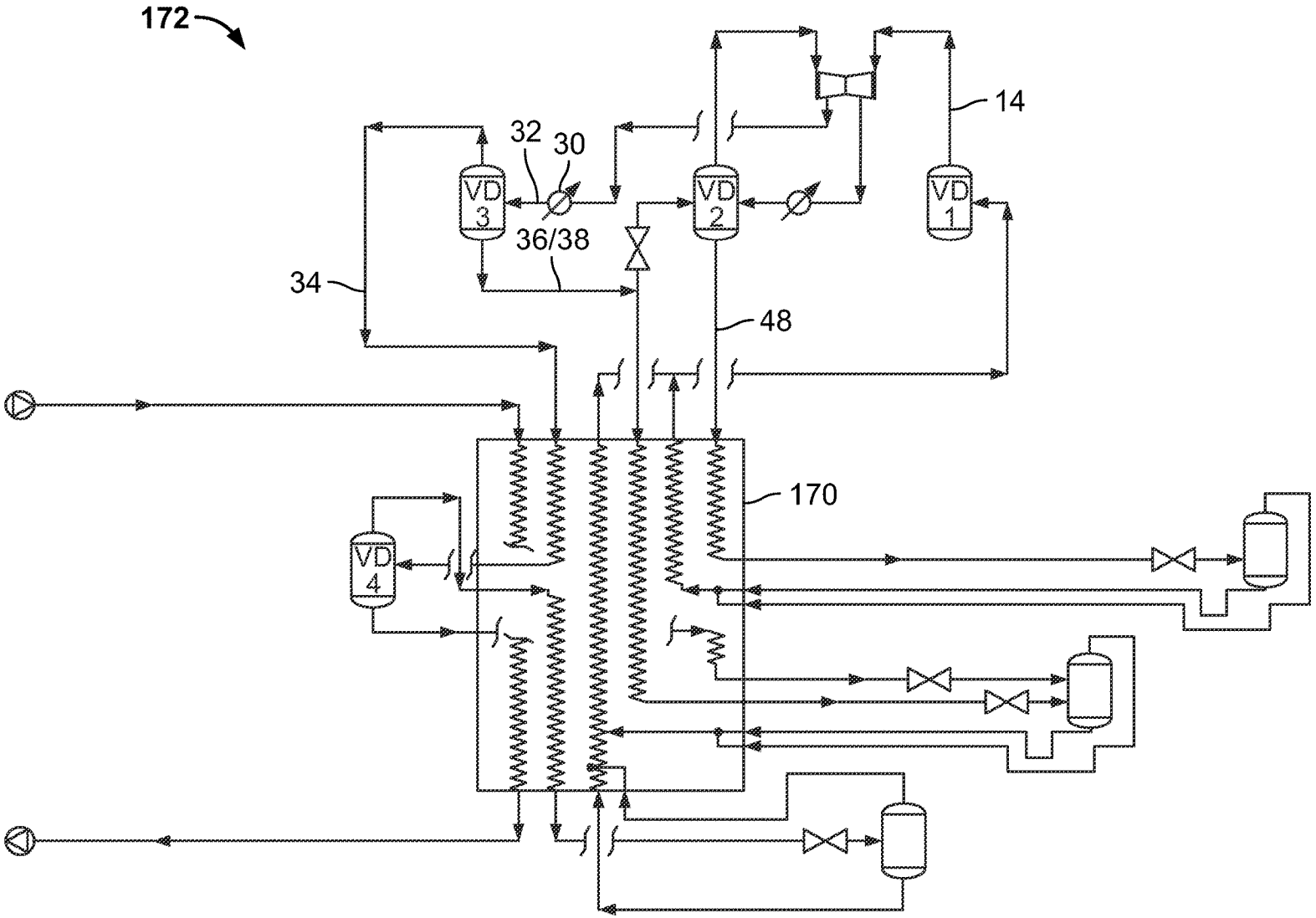
FIG. 12 is a process flow diagram and schematic illustrating an eleventh embodiment of a process and system of the invention.

FIG. 8 shows an example of different refrigerant return streams returning to suction separation device VD1. FIG. 9 shows several embodiments including feed fluid outlets and inlets 162A and 162B for external feed treatment, such as natural gas liquids recovery or nitrogen rejection, or the like.

Furthermore, while the present system and method are described below in terms of liquefaction of natural gas, they may be used for the cooling, liquefaction and/or processing of gases other than natural gas including, but not limited to, air or nitrogen.

The removal of heat is accomplished in the heat exchanger using a single mixed refrigerant in the systems described herein. Exemplary refrigerant compositions, conditions and flows of the streams of the refrigeration portion of the system, as described below, which are not intended to be limiting, are presented in Tables 1 and 2.

In one embodiment, warm, high pressure, vapor refrigerant stream 34 is cooled, condensed and subcooled as it travels through high pressure vapor passage 166/168 of the heat exchanger 170. As a result, stream 112 exits the cold end of the heat exchanger 170. Stream 112 is flashed through expansion valve 114 and re-enters the heat exchanger as stream 122 to provide refrigeration as stream 104 traveling through primary refrigeration passage 104. As an alternative to the expansion valve 114, another type of expansion device could be used, including, but not limited to, a turbine or an orifice.

Warm, high pressure liquid refrigerant stream 38 enters the heat exchanger 170 and is subcooled in high pressure liquid passage 136. The resulting stream 124 exits the heat exchanger and is flashed through expansion valve 126. As an alternative to the expansion valve 126, another type of expansion device could be used, including, but not limited to, a turbine or an orifice. Significantly, the resulting stream 132 rather than re-entering the heat exchanger 170 directly to join the primary refrigeration passage 104, first joins the subcooled cold separator vapor liquid 128 to form a middle temperature refrigerant stream 148. The middle temperature refrigerant stream 148 then re-enters the heat exchanger wherein it joins the low pressure mixed phase stream 122 in primary refrigeration passage 104. Thus combined, and warmed, the refrigerants exit the warm end of the heat exchanger 170 as vapor refrigerant return stream 104A, which may be optionally superheated.

In one embodiment, vapor refrigerant return stream 104A and stream 108A which, may be mixed phase or vapor phase, may exit the warm end of the heat exchanger separately, e.g., each through a distinct outlet, or they may be combined within the heat exchanger and exit together, or they may exit the heat exchanger into a common header attached to the heat exchanger before returning to the suction separation device VD1. Alternatively, streams 104A and 108A may exit separately and remain so until combining in the suction separation device VD1, or they may, through vapor and mixed phase inlets, respectively, and are combined and equilibrated in the low pressure suction drum. While a suction drum VD1 is illustrated, alternative separation devices may be used, including, but not limited to, another type of vessel, a cyclonic separator, a distillation unit, a coalescing separator or mesh or vane type mist eliminator. As a result, a low pressure vapor refrigerant stream 14 exits the vapor outlet of drum VD1. As stated above, the stream 14 travels to the inlet of the first stage compressor 16. The blending of mixed phase stream 108A with stream 104A, which includes a vapor of greatly different composition, in the suction drum VD1 at the suction inlet of the compressor 16 creates a partial flash cooling effect that lowers the temperature of the vapor stream traveling to the compressor, and thus the compressor itself, and thus reduces the power required to operate it.

In one embodiment, a pre-cool refrigerant loop enters the warm side of the heat exchanger 170 and exits with a significant liquid fraction. The partially liquid stream 108A is combined with spent refrigerant vapor from stream 104A for equilibration and separation in suction drum VD1, compression of the resultant vapor in compressor 16 and pumping of the resulting liquid by pump P. In the present case, equilibrium is achieved as soon as mixing occurs, i.e., in the header, static mixer, or the like. In one embodiment, the drum merely protects the compressor. The equilibrium in suction drum VD1 reduces the temperature of the stream entering the compressor 16, by both heat and mass transfer, thus reducing the power usage by the compressor.

Other embodiments shown in FIG. 9 include various separation devices in the warm, middle, and cold refrigeration loops. In one embodiment, warm temperature refrigerant passage 158 is in fluid communication with a separation device.

In one embodiment, the warm temperature refrigerant passage 158 is in fluid communication with an accumulator separation device VD5 having a vapor outlet in fluid communication with a warm temperature refrigerant vapor passage 158*v* and a liquid outlet in fluid communication with a warm temperature refrigerant liquid passage 1581.

In one embodiment, the warm temperature refrigerant vapor and liquid passages 158*v* and 1581 are in fluid communication with the low pressure high-boiling stream passage 108.

In one embodiment, the warm temperature refrigerant vapor and liquid passages 158*v* and 1581 are in fluid communication with each other either inside the heat exchanger or in a header outside the heat exchanger.

In one embodiment, the flashed cold separator liquid stream passage 134 is in fluid communication with an accumulator separation device VD6 having a vapor outlet in fluid communication with a middle temperature refrigerant vapor passage 148*v*, and a liquid outlet in fluid communication with a middle temperature refrigerant liquid passage 148*l*.

In one embodiment, the middle temperature refrigerant vapor and liquid passages 148*v* and 148*l* are in fluid communication with the low pressure mixed refrigerant passage 104.

In one embodiment, the middle temperature refrigerant vapor and liquid passages 148*v* and 148*l* are in fluid communication with each other either inside the heat exchanger or in a header outside the heat exchanger.

In one embodiment, the flashed mid-boiling refrigerant liquid stream passage 132 is in fluid communication with an accumulator separation device VD6 having a vapor outlet in fluid communication with a middle temperature refrigerant vapor passage 148*v* and a liquid outlet in fluid communication with a middle temperature refrigerant liquid passage 148*l*.

In one embodiment, the middle temperature refrigerant vapor and liquid passages 148*v* and 148*l* are in fluid communication with the low pressure mixed refrigerant passage 104.

In one embodiment, the middle temperature refrigerant vapor and liquid passages 148*v* and 148*l* are in fluid communication with each other either inside the heat exchanger or in a header outside the heat exchanger.

In one embodiment, the flashed mid-boiling refrigerant liquid stream 132 and the flashed cold separator liquid stream 134 are in fluid communication with an accumulator separation device VD6 having a vapor outlet in fluid communication with a middle temperature refrigerant vapor passage 148*v* and a liquid outlet in fluid communication with a middle temperature refrigerant liquid passage 148*l*.

In one embodiment, the middle temperature refrigerant vapor and liquid passages 148*v* and 148*l* are in fluid communication with the low pressure mixed refrigerant passage 104.

In one embodiment, the middle temperature refrigerant vapor and liquid passages 148*v* and 148*l* are in fluid communication with each other either inside the heat exchanger or in a header outside the heat exchanger.

In one embodiment, the flashed mid-boiling refrigerant liquid stream 132 and the flashed cold separator liquid stream 134 are in fluid communication with each other prior to fluidly communicating with the accumulator separation device VD6.

In one embodiment, the low pressure mixed phase stream passage 122 is in fluid communication with an accumulator separation device VD7 having a vapor outlet in fluid communication with a cold temperature refrigerant vapor passage 122*v*, and a cold temperature liquid passage 1221.

In one embodiment, the cold temperature refrigerant vapor passage 122*v* and a cold temperature liquid passage 1221 are in fluid communication with the low pressure mixed refrigerant passage 104.

In one embodiment, the cold temperature refrigerant vapor passage 122*v* and cold temperature liquid passage 1221 are in fluid communication with each other either inside the heat exchanger or in a header outside the heat exchanger.

In one embodiment, each of the warm temperature refrigerant passage 158, flashed cold separator liquid stream passage 134, low pressure mid-boiling refrigerant passage 132, low pressure mixed phase stream passage 122 is in fluid communication with a separation device.

In one embodiment, one or more precooler may be present in series between elements 16 and VD2.

In one embodiment, one or more precooler may be present in series between elements 30 and VD3.

In one embodiment, a pump may be present between a liquid outlet of VD1 and the inlet of VD2. In some embodiments, a pump may be present between a liquid outlet of VD1 and having an outlet in fluid communication with elements 18 or 22.

In one embodiment, the pre-cooler is a propane, ammonia, propylene, ethane, pre-cooler.

In one embodiment, the pre-cooler features 1, 2, 3, or 4 multiple stages.

In one embodiment, the mixed refrigerant comprises 2, 3, 4, or 5 C1-C5 hydrocarbons and optionally N2.

In one embodiment, the suction separation device includes a liquid outlet and further comprising a pump having an inlet and an outlet, wherein the outlet of the suction separation device is in fluid communication with the inlet of the pump, and the outlet of the pump is in fluid communication with the outlet of the aftercooler.

In one embodiment, the mixed refrigerant system a further comprising a pre-cooler in series between the outlet of the intercooler and the inlet of the interstage separation device and wherein the outlet of the pump is also in fluid communication with the pre-cooler.

In one embodiment, the suction separation device is a heavy component refrigerant accumulator whereby vaporized refrigerant traveling to the inlet of the compressor is maintained generally at a dew point.

In one embodiment, the high pressure accumulator is a drum.

In one embodiment, an interstage drum is not present between the suction separation device and the accumulator separation device.

In one embodiment, the first and second expansion devices are the only expansion devices in closed-loop communication with the main process heat exchanger.

In one embodiment, an aftercooler is the only aftercooler present between the suction separation device and the accumulator separation device.

In one embodiment, the heat exchanger does not have a separate outlet for a pre-cool refrigeration passage.

Further embodiments of the disclosure recognize that the circulation rate of the intermediate-boiling refrigerant components (esp. ethylene and/or ethane) may be adjusted by changing the liquid level controller set point for the cold vapor separator, and that proper adjustments of this level controller set point can have significant potential benefit for efficiency and/or production.

Figure 13:
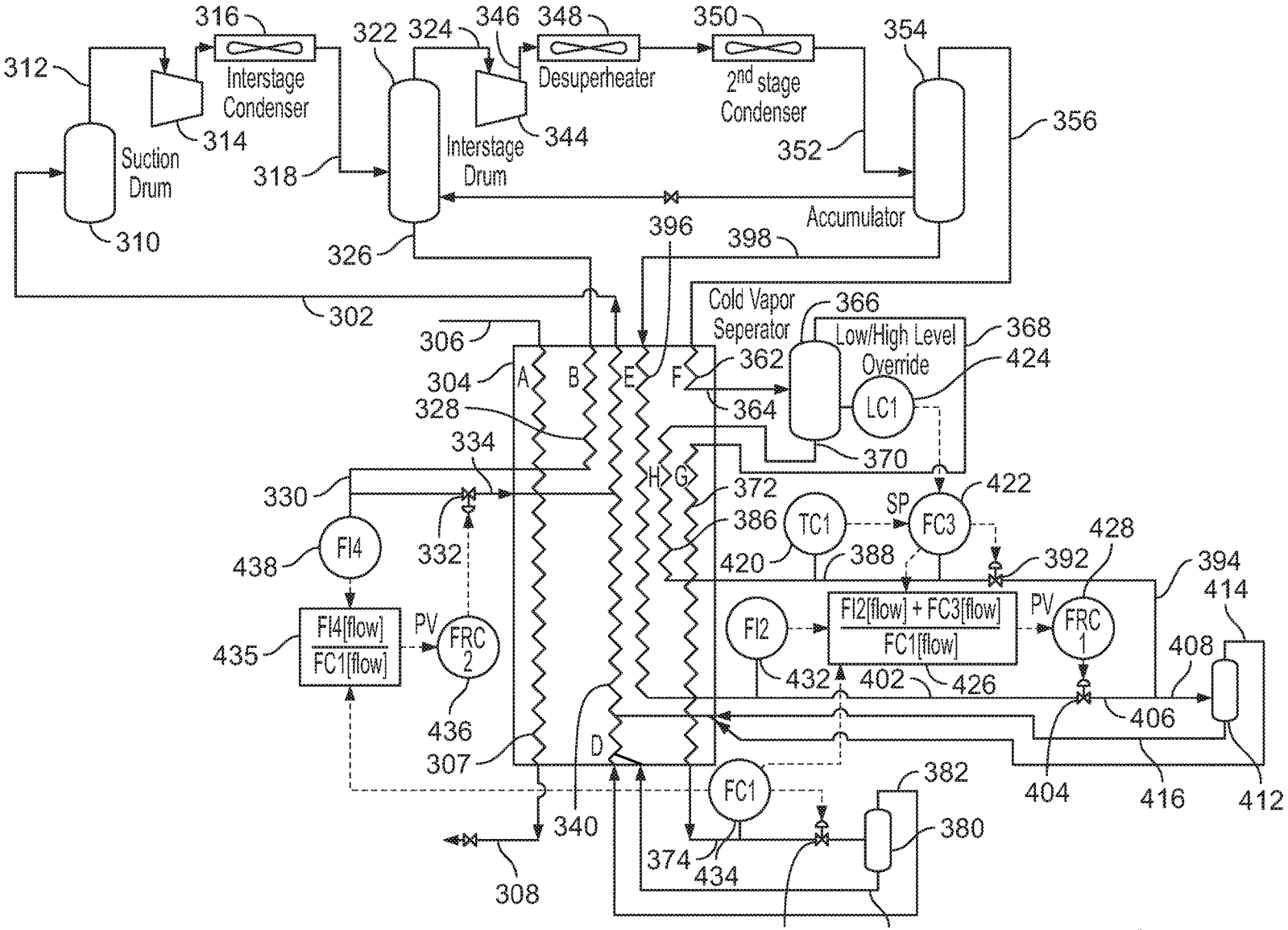
FIG. 13 is a process flow diagram and schematic illustrating a twelfth embodiment of a process and system of the invention.
Figure 14:
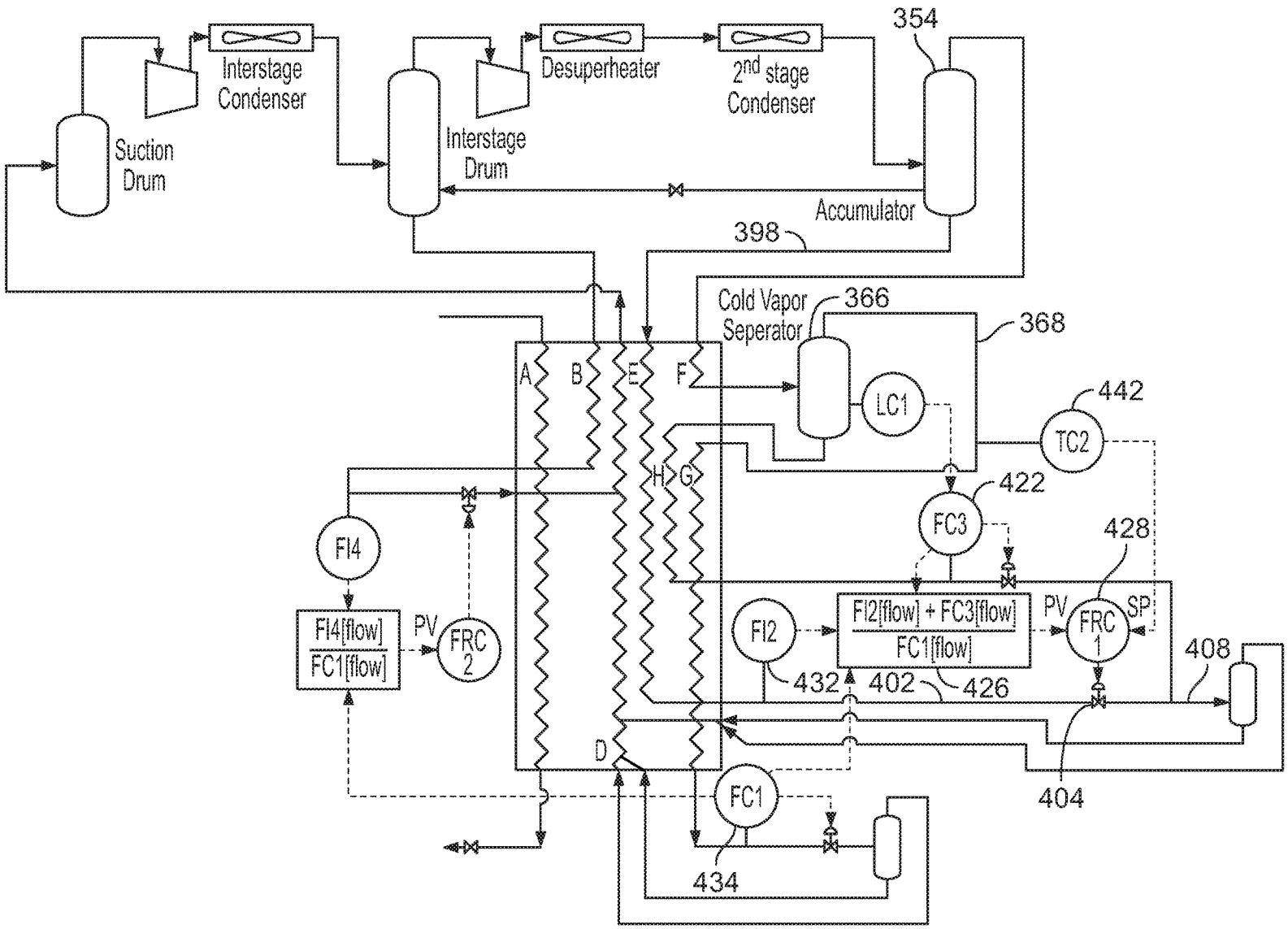
FIG. 14 is a process flow diagram and schematic illustrating a thirteenth embodiment of a process and system of the invention.
Figure 15:
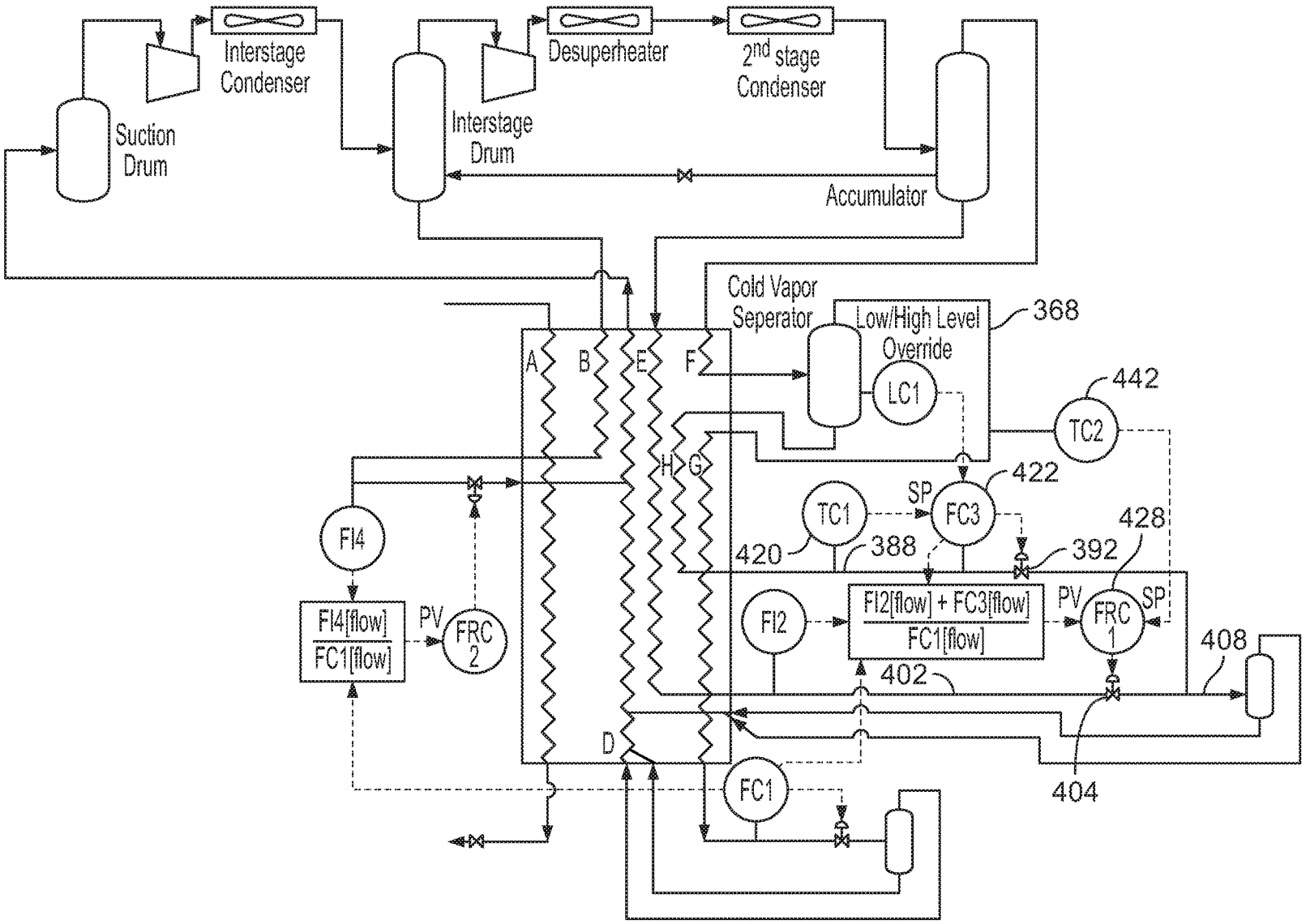
FIG. 15 is a process flow diagram and schematic illustrating a fourteenth embodiment of a process and system of the invention.

Systems where enhanced control schemes automate the adjustment of the liquid level in the cold vapor separator and the relative flows of the liquids from the interstage drum and from the MR accumulator so as to optimize the composition of the circulating refrigerant are illustrated in FIGS. 13-15. The enhanced control schemes may make these adjustments based on various process temperatures (such as certain liquefying heat exchanger outlet temperatures), ambient temperature, process pressures, liquid levels in other vessels, process composition measurements, or some combination of these parameters In the system illustrated in FIG. 13, vaporized (or mixed phase) mixed refrigerant return stream 302 exits main heat exchanger 304 wherein the mixed refrigerant has been used to liquefy a natural gas feed stream 306 in feed fluid cooling passage 307 so that a liquid natural gas product stream 308 is produced. While the system is described in terms of liquefying natural gas, the technology may be used to cool other types of fluid streams.

Stream 302 is directed to suction drum 310. A first stage compressor 314 receives a low pressure vapor refrigerant stream 312 and compresses it to an intermediate pressure. The stream then travels to a first stage aftercooler 316 where it is cooled. Aftercooler 316 may be, as an example, a heat exchanger. The resulting intermediate pressure mixed phase refrigerant stream 318 travels to interstage drum 322. While an interstage drum 322 is illustrated, alternative separation devices may be used, including, but not limited to, another type of vessel, a cyclonic separator, a distillation unit, a coalescing separator or mesh or vane type mist eliminator.

An intermediate pressure vapor stream 324 exits the vapor outlet of the drum 322 and intermediate pressure liquid stream 326 exits the liquid outlet of the drum. Intermediate pressure liquid stream 326, which is warm and a heavy fraction, exits the liquid side of drum 322 and enters pre-cool liquid passage 328 of heat exchanger 304 and is subcooled by heat exchange with the various cooling streams, described below, also passing through the heat exchanger. The resulting stream 330 exits the heat exchanger and is flashed through pre-cool expansion device or valve 332. The resulting stream 334 reenters the heat exchanger to join the primary refrigeration passage 340. In an alternative embodiment, the stream 334 may instead be directed to a dedicated pre-cool refrigeration passage that is separate from the primary refrigeration passage 340, where the pre-cool refrigeration passage has an outlet that is also in fluid communication with suction drum 310.

Intermediate pressure vapor stream 324 travels from the vapor outlet of drum 322 to second or last stage compressor 344 where it is compressed to a high pressure. Stream 346 exits the compressor 344 and travels through desuperheater cooling device 348 and then second or last stage aftercooler 350 where it is cooled. The resulting stream 352 contains both vapor and liquid phases which are separated in high pressure accumulator drum 354. While an accumulator drum 354 is illustrated, alternative separation devices may be used, including, but not limited to, another type of vessel, a cyclonic separator, a distillation unit, a coalescing separator or mesh or vane type mist eliminator. High pressure vapor refrigerant stream 356 exits the vapor outlet of high pressure accumulator 354 and travels to the warm side of the heat exchanger 304. High pressure liquid refrigerant stream 398 exits the liquid outlet of high pressure accumulator 354 and also travels to the warm end of the heat exchanger 304.

The heat exchanger includes a high pressure vapor passage 362 that receives the high pressure vapor stream 356 and cools the high pressure vapor stream to form a mixed phase cold separator feed stream 364 that is fed to a cold vapor separator 366 so that a cold separator vapor stream 368 and a cold separator liquid stream 370 are formed.

The heat exchanger includes a cold separator vapor passage 372 having an inlet in communication with the vapor stream outlet of the cold vapor separator 366. The cold separator vapor stream 368 is cooled in passage 372 and condensed into liquid stream 374, and then flashed with cold temperature expansion device or valve 376 with the resulting mixed phase cold temperature refrigerant stream directed to cold temperature separation device 380. The resulting vapor and liquid streams 382 and 384 are directed to the primary refrigeration passage 340.

The cold separator liquid stream 370 is cooled in cold separator liquid passage 386 to form subcooled cold separator liquid stream 388. This stream 388 is flashed at cold separator liquid expansion device or valve 392 to form mixed phase stream 394. Expansion valve 392 may be adjusted to control (increase or decrease) the flow rate of fluid passing through the device.

A high pressure liquid passage 396 of the heat exchanger 304 receives the high pressure liquid stream 398 from the high pressure accumulator separation device 354 on the compression side. In one embodiment, the high pressure liquid stream 398 is a mid-boiling refrigerant liquid stream. The high pressure liquid stream enters the warm end of the heat exchanger 304 and is cooled to form a subcooled high pressure liquid stream 402. Stream 402 is flashed in high pressure liquid expansion device or valve 404 and the resulting mixed phase stream 406 is combined with mixed phase stream 394 to form a mixed phase middle temperature refrigerant stream 408. Mixed phase middle temperature stream 408 is separated in middle temperature separation device 412 to form middle temperature vapor stream 414 and middle temperature liquid stream 416 which are directed to primary refrigeration passage 340 to provide refrigeration therein.

The system illustrated in FIG. 13 includes one possible enhancement of controls intended to optimize the system performance. The system of FIG. 13 includes a temperature sensor 420 that is configured to determine the temperature of subcooled cold vapor separator liquid stream 388 and is in communication with a flow controller and sensor 422, which controls expansion valve 392 and detects the flow rate of fluid there through. A liquid level sensor 424 is also in communication with the flow controller and sensor 422 and is configured to determine the level of liquid within the cold vapor separator 366.

In the system of FIG. 13, the flow of liquid from the cold vapor separator 366 is controlled via expansion valve 392 so as to maintain a generally constant temperature for subcooled cold vapor separator liquid stream 388 (i.e. at the point at which this flow exits the heat exchanger 304). More specifically, ethylene and/or ethane are sequestered or released from the cold vapor separator 366 via adjustment of expansion valve 392 so as to maintain a generally constant temperature (as sensed by temperature sensor 420) at a selected set point in the overall temperature profile and dictate the composition of the middle temperature refrigerant stream 408. Flow controller and sensor 422 compares the set point temperature with the temperature detected by temperature sensor 420 and adjusts expansion valve 392 so that the temperature of stream 388 generally matches the set point temperature.

The level control in the cold vapor separator 366 only serves an override function in that flow controller and sensor 422 opens the expansion valve 392 so as to permit greater liquid flow from the cold vapor separator when the liquid level within the cold vapor separator (as detected by liquid level sensor 424) rises above a pre-determined maximum level. Conversely, the flow controller and sensor 422 may adjust the expansion valve 392 so as to further restrict flow of liquid from the cold vapor separator if the liquid level within the cold vapor separator drops below a predetermined minimum level.

A flow ratio controller 428 controls the setting of expansion valve 404. As indicated by block 426, which represents processing performed by flow ratio controller 428, the setting of the expansion valve 404 is proportional to the flow rate of stream 402, as measured by flow sensor 432, plus the flow rate of stream 388 (from flow controller and sensor 422) divided by the flow rate sensed by flow controller and sensor 434.

Flow controller and sensor 434 determines the flow rate of liquid stream 374 and controls cold temperature expansion device 376. Flow controller and sensor 434 is set based on the desired power consumption in the compressors 314/344 or desired production.

As further illustrated by block 435 in FIG. 13, a flow ratio controller 436 controls pre-cool expansion device 332 in proportion to the flow rate of stream 330, as measured by flow sensor 438, divided by the flow rate of stream 374, as measured by flow controller and sensor 434.

While individual flow controllers and flow ratio controllers for controlling expansion valves are illustrated in FIG. 13, a single system controller may instead incorporate all or some of the individual flow and flow ratio controllers of FIG. 13.

Another possible enhanced control scheme is illustrated in FIG. 14. The system of FIG. 14 features the same components and functionality, with the same reference numbers used, as the system of FIG. 13 with the following exceptions. In the system of FIG. 14, the liquid flow 398 from the high pressure accumulator 354 is adjusted so as to maintain a constant temperature at the cold vapor separator 366. This is accomplished by flow ratio controller 428 receiving a temperature of the vapor stream 368 from the cold vapor separator via temperature sensor 442. The flow ratio controller 428 compares the temperature sensed via temperature sensor 442 with a predetermined set point temperature and adjusts expansion valve 404 so that the temperature of stream 368 generally matches the set point temperature. This adjusts the circulation rates of butane and propane relative to the other refrigerants, thereby adjusting the temperature profile and dictating the composition of the middle temperature refrigerant stream 408. The flow ratio controller 428 also makes adjustments based on the flow data received from flow controller and sensor 422, flow sensor 432 and flow controller and sensor 434, as described above with reference to FIG. 13.

The system of FIG. 15 features a combination of the control enhancements of FIGS. 13 and 14 and demonstrates the means by which multiple enhancements may be combined. The system of FIG. 15 features the same components and functionality, with the same reference numbers used, as the systems of FIGS. 13 and 14. In the system of FIG. 15, as described with reference to FIG. 13, flow controller and sensor 422 compares the set point temperature with the temperature in stream 388 detected by temperature sensor 420 and adjusts expansion valve 392 so that the temperature of stream 388 generally matches the set point temperature. In addition, as described with reference to FIG. 14, flow ratio controller 428 compares the temperature sensed in stream 368 via temperature sensor 442 with a predetermined set point temperature and adjusts expansion valve 404 for stream 402 so that the temperature of stream 368 generally matches the set point temperature.

INCORPORATION BY REFERENCE

The contents of U.S. Pat. No. 9,441,877, issued Sep. 13, 2016, and U.S. Pat. No. 6,333,445, issued Dec. 25, 2001, are hereby incorporated by reference.

While the preferred embodiments of the invention have been shown and described, it will be apparent to those skilled in the art that changes and modifications may be made therein without departing from the spirit of the invention, the scope of which is defined by the claims and elsewhere herein.

TABLE 1

| | | Stream Name | | | | | |
|---|---|---|---|---|---|---|---|
| | | FEED | PRODUCT | 14 | 18 | 22 | 24 |
| | | Stream Description | | | | | |
| | | Feed Gas | LNG | 1st Stage Inlet | 1st Stage Discharge | Interstage Drum Inlet | 2nd Stage Inlet |
| Phase | | Vapor | Liquid | Vapor | Vapor | Mixed | Vapor |
| Temperature | C. | 34.59 | −163.00 | 9.38 | 80.42 | 35.00 | 34.77 |
| Pressure | BAR | 54.01 | 53.61 | 4.40 | 16.99 | 16.51 | 16.51 |
| Flowrate | KG-MOL/HR | 1,003.3 | 1,003.3 | 3,429.2 | 3,429.2 | 3,429.2 | 2,913.2 |

TABLE 1-continued

| | | | | | | | |
|---|---|---|---|---|---|---|---|
| Total Mass Rate | KG/HR | 16,356.5 | 16,356.5 | 124,209.4 | 124,209.4 | 124,209.4 | 96,868.1 |
| Total Molecular Weight | | 16.30 | 16.30 | 36.22 | 36.22 | 36.22 | 33.25 |
| Composition | | | | | | | |
| N2 | Mole % | 1.00 | 1.00 | 6.31 | 6.31 | 6.31 | 7.38 |
| METHANE | | 98.00 | 98.00 | 19.32 | 19.32 | 19.32 | 22.41 |
| C2H4 | | 0.00 | 0.00 | 33.83 | 33.83 | 33.83 | 38.49 |
| ETHANE | | 1.00 | 1.00 | 0.00 | 0.00 | 0.00 | 0.00 |
| C3 | | 0.00 | 0.00 | 12.14 | 12.14 | 12.14 | 11.74 |
| BUTANE | | 0.00 | 0.00 | 28.41 | 28.41 | 28.41 | 19.98 |
| High/Low Ranges | | | | | | | |
| High Temperature | C. | 50.00 | −140.00 | 50.00 | | 50.00 | |
| Low Temperature | C. | −40.00 | −165.00 | −60.00 | | −40.00 | |
| High Pressure | BAR | 72.00 | 72.00 | 12.00 | | 25.00 | |
| Low Pressure | BAR | 20.00 | 20.00 | 2.00 | | 8.00 | |

| | | Stream Name | | | | |
|---|---|---|---|---|---|---|
| | | 28 | 32 | 34 | 36 | 38 |
| | | Stream Description | | | | |
| | | 2nd Stage Discharge | Accumulator Inlet | Accumulator Vapor | Accumulator Liquid | Mid Boiling Refrigerant Inlet |
| Phase | | Vapor | Mixed | Vapor | Liquid | Liquid |
| Temperature | C. | 68.16 | 35.00 | 35.00 | 35.00 | 35.00 |
| Pressure | BAR | 27.88 | 27.40 | 27.40 | 27.40 | 27.40 |
| Flowrate | KG-MOL/HR | 2,913.2 | 2,913.2 | 2,474.4 | 438.8 | 351.0 |
| Total Mass Rate | KG/HR | 96,868.1 | 96,868.1 | 75,527.5 | 21,340.6 | 17,072.5 |
| Total Molecular Weight | | 33.25 | 33.25 | 30.52 | 48.64 | 48.64 |
| Composition | | | | | | |
| N2 | Mole % | 7.38 | 7.38 | 8.58 | 0.60 | 0.60 |
| METHANE | | 22.41 | 22.41 | 25.60 | 4.42 | 4.42 |
| C2H4 | | 38.49 | 38.49 | 42.49 | 15.94 | 15.94 |
| ETHANE | | 0.00 | 0.00 | 0.00 | 0.00 | 0.00 |
| C3 | | 11.74 | 11.74 | 10.47 | 18.92 | 18.92 |
| BUTANE | | 19.98 | 19.98 | 12.86 | 60.12 | 60.12 |
| High/Low Ranges | | | | | | |
| High Temperature | C. | 130.00 | 50.00 | | | |
| Low Temperature | C. | 40.00 | −40.00 | | | |
| High Pressure | BAR | 72.00 | 72.00 | | | |
| Low Pressure | BAR | 22.00 | 22.00 | | | |

| | | Stream Name | | | | |
|---|---|---|---|---|---|---|
| | | 40 | 48 | 104 A | 108A | 112 |
| | | Stream Description | | | | |
| | | Spillback | High Boiling Refrigerant Inlet | Low Pressure MR Vapor Outlet | Low Pressure High Boiling Refrigerant Outlet | Subcooled Cold Separator Vapor |
| Phase | | Liquid | Liquid | Vapor | Mixed | Liquid |
| Temperature | C. | 35.00 | 34.77 | 31.88 | 31.88 | −163.00 |
| Pressure | BAR | 27.40 | 16.51 | 4.50 | 4.50 | 27.20 |
| Flowrate | KG-MOL/HR | 87.8 | 603.8 | 2,825.4 | 603.8 | 998.7 |
| Total Mass Rate | KG/HR | 4,268.1 | 31,609.3 | 92,600.0 | 31,609.4 | 23,176.3 |
| Total Molecular Weight | | 48.64 | 52.35 | 32.77 | 52.35 | 23.21 |
| Composition | | | | | | |
| N2 | Mole % | 0.60 | 0.28 | 7.59 | 0.28 | 18.95 |
| METHANE | | 4.42 | 2.26 | 22.96 | 2.26 | 43.53 |
| C2H4 | | 15.94 | 8.72 | 39.19 | 8.72 | 35.60 |
| ETHANE | | 0.00 | 0.00 | 0.00 | 0.00 | 0.00 |
| C3 | | 18.92 | 15.05 | 11.52 | 15.05 | 1.35 |
| BUTANE | | 60.12 | 73.68 | 18.73 | 73.68 | 0.57 |
| High/Low Ranges | | | | | | |
| High Temperature | C. | | | | | −140.00 |
| Low Temperature | C. | | | | | −170.00 |
| High Pressure | BAR | | | | | 72.00 |
| Low Pressure | BAR | | | | | 22.00 |

TABLE 1-continued

| | | Stream Name | | | | |
|---|---|---|---|---|---|---|
| | | 122 | 124 | 128 | 132 | 140 |
| | | Stream Description | | | | |
| | | Low Pressure MR Inlet | Subcooled Mid Boiling Refrigerant | Subcooled Cold Separator Liquid | Low Pressure Mid Boiling Refrigerant Inlet | Subcooled High Boilng Refrigerant |
| Phase | | Mixed | Liquid | Liquid | Liquid | Liquid |
| Temperature | C. | −166.52 | −95.00 | −91.58 | −93.97 | −65.00 |
| Pressure | BAR | 4.80 | 27.20 | 27.20 | 4.70 | 16.31 |
| Flowrate | KG-MOL/HR | 998.7 | 351.0 | 1,475.7 | 351.0 | 603.8 |
| Total Mass Rate | KG/HR | 23,176.3 | 17,072.5 | 52,351.2 | 17,072.5 | 31,609.4 |
| Total Molecular Weight | | 23.21 | 48.64 | 35.47 | 48.64 | 52.35 |
| Composition | | | | | | |
| N2 | Mole % | 18.95 | 0.60 | 1.57 | 0.60 | 0.28 |
| METHANE | | 43.53 | 4.42 | 13.46 | 4.42 | 2.26 |
| C2H4 | | 35.60 | 15.94 | 47.15 | 15.94 | 8.72 |
| ETHANE | | 0.00 | 0.00 | 0.00 | 0.00 | 0.00 |
| C3 | | 1.35 | 18.92 | 16.64 | 18.92 | 15.05 |
| BUTANE | | 0.57 | 60.12 | 21.18 | 60.12 | 73.68 |
| High/Low Ranges | | | | | | |
| High Temperature | C. | −145.00 | −50.00 | −50.00 | −55.00 | −20.00 |
| Low Temperature | C. | −175.00 | −135.00 | −135.00 | −140.00 | −90.00 |
| High Pressure | BAR | 12.00 | 72.00 | 72.00 | 12.00 | 25.00 |
| Low Pressure | BAR | 2.00 | 22.00 | 22.00 | 2.00 | 8.00 |

| | | Stream Name | | | |
|---|---|---|---|---|---|
| | | 158 | 156 | 160 | 164 |
| | | Stream Description | | | |
| | | Low Pressure High Boiling Refrigerant Inlet | Cold Separator Liquid | Cold Separator Vapor | Cold Separator Feed |
| Phase | | Liquid | Liquid | Vapor | Mixed |
| Temperature | C. | −64.49 | −39.00 | −39.00 | −39.00 |
| Pressure | BAR | 4.70 | 27.20 | 27.20 | 27.20 |
| Flowrate | KG-MOL/HR | 603.8 | 1,475.7 | 998.7 | 2,474.4 |
| Total Mass Rate | KG/HR | 31,609.4 | 52,351.2 | 23,176.3 | 75,527.5 |
| Total Molecular Weight | | 52.35 | 35.47 | 23.21 | 30.52 |
| Composition | | | | | |
| N2 | Mole % | 0.28 | 1.57 | 18.95 | 8.58 |
| METHANE | | 2.26 | 13.46 | 43.53 | 25.60 |
| C2H4 | | 8.72 | 47.15 | 35.60 | 42.49 |
| ETHANE | | 0.00 | 0.00 | 0.00 | 0.00 |
| C3 | | 15.05 | 16.64 | 1.35 | 10.47 |
| BUTANE | | 73.68 | 21.18 | 0.57 | 12.86 |
| High/Low Ranges | | | | | |
| High Temperature | C. | −25.00 | | | −20.00 |
| Low Temperature | C. | −95.00 | | | −80.00 |
| High Pressure | BAR | 12.00 | | | 72.00 |
| Low Pressure | BAR | 2.00 | | | 22.00 |

TABLE 2

| | | Stream Name | | | | | |
|---|---|---|---|---|---|---|---|
| | | FEED | PRODUCT | 14 | 14L | 18 | 18L |
| | | Stream Description | | | | | |
| | | Feed Gas | LNG | 1st Stage Inlet | MR Pump Inlet | 1st Stage Discharge | MR Pump Discharge |
| Phase | | Vapor | Liquid | Vapor | Liquid | Vapor | Liquid |
| Temperature | C. | 34.59 | −163.00 | 8.00 | 7.12 | 78.07 | 8.10 |
| Pressure | BAR | 54.01 | 53.61 | 4.40 | 4.40 | 16.99 | 16.99 |
| Flowrate | KG-MOL/HR | 1,003.3 | 1,003.3 | 3,503.5 | 59.4 | 3,503.5 | 59.4 |

TABLE 2-continued

| | | | | | | | |
|---|---|---|---|---|---|---|---|
| Total Mass Rate | KG/HR | 16,356.5 | 16,356.5 | 128,829.6 | 3,313.3 | 128,829.6 | 3,313.3 |
| Total Molecular Weight | | 16.30 | 16.30 | 36.77 | 55.79 | 36.77 | 55.79 |
| Composition | | | | | | | |
| N2 | Mole % | 1.00 | 1.00 | 6.17 | 0.00 | 6.17 | 0.00 |
| METHANE | | 98.00 | 98.00 | 18.83 | 0.01 | 18.83 | 0.01 |
| C2H4 | | 0.00 | 0.00 | 32.96 | 0.03 | 32.96 | 0.03 |
| ETHANE | | 1.00 | 1.00 | 0.00 | 0.00 | 0.00 | 0.00 |
| C3 | | 0.00 | 0.00 | 11.83 | 0.09 | 11.83 | 0.09 |
| BUTANE | | 0.00 | 0.00 | 30.21 | 0.88 | 30.21 | 0.88 |
| High/Low Ranges | | | | | | | |
| High Temperature | C. | 50.00 | −140.00 | 50.00 | 50.00 | | |
| Low Temperature | C. | −40.00 | −165.00 | −60.00 | −60.00 | | |
| High Pressure | BAR | 72.00 | 72.00 | 12.00 | 12.00 | | |
| Low Pressure | BAR | 20.00 | 20.00 | 2.00 | 2.00 | | |

| | | Stream Name | | | | |
|---|---|---|---|---|---|---|
| | | 22 | 24 | 28 | 32 | 34 |
| | | Stream Description | | | | |
| | | Interstage Drum Inlet | 2nd Stage Inlet | 2nd Stage Discharge | Accumulator Inlet | Accumulator Vapor |
| Phase | | Mixed | Vapor | Vapor | Mixed | Vapor |
| Temperature | C. | 35.00 | 34.79 | 68.20 | 35.00 | 35.00 |
| Pressure | BAR | 16.51 | 16.51 | 27.88 | 27.40 | 27.40 |
| Flowrate | KG-MOL/HR | 3,503.5 | 2,870.5 | 2,870.5 | 2,870.5 | 2,442.0 |
| Total Mass Rate | KG/HR | 128,829.6 | 95,329.7 | 95,329.7 | 95,329.7 | 74,449.1 |
| Total Molecular Weight | | 36.77 | 33.21 | 33.21 | 33.21 | 30.49 |
| Composition | | | | | | |
| N2 | Mole % | 6.17 | 7.48 | 7.48 | 7.48 | 8.68 |
| METHANE | | 18.83 | 22.54 | 22.54 | 22.54 | 25.72 |
| C2H4 | | 32.96 | 38.53 | 38.53 | 38.53 | 42.50 |
| ETHANE | | 0.00 | 0.00 | 0.00 | 0.00 | 0.00 |
| C3 | | 11.83 | 11.35 | 11.35 | 11.35 | 10.13 |
| BUTANE | | 30.21 | 20.11 | 20.11 | 20.11 | 12.97 |
| High/Low Ranges | | | | | | |
| High Temperature | C. | 50.00 | | 130.00 | 50.00 | |
| Low Temperature | C. | −40.00 | | 40.00 | −40.00 | |
| High Pressure | BAR | 25.00 | | 72.00 | 72.00 | |
| Low Pressure | BAR | 8.00 | | 22.00 | 22.00 | |

| | | Stream Name | | | | |
|---|---|---|---|---|---|---|
| | | 36 | 38 | 40 | 48 | 104A |
| | | Stream Description | | | | |
| | | Accumulator Liquid | Mid Boiling Refrigerant Inlet | Spillback | High Boiling Refrigerant Inlet | Low Pressure MR Vapor Outlet |
| Phase | | Liquid | Liquid | Liquid | Liquid | Vapor |
| Temperature | C. | 35.00 | 35.00 | 35.00 | 34.79 | 31.01 |
| Pressure | BAR | 27.40 | 27.40 | 27.40 | 16.51 | 4.50 |
| Flowrate | KG-MOL/HR | 428.5 | 342.8 | 85.7 | 718.7 | 2,784.8 |
| Total Mass Rate | KG/HR | 20,880.6 | 16,704.5 | 4,176.1 | 37,676.0 | 91,153.6 |
| Total Molecular Weight | | 48.73 | 48.73 | 48.73 | 52.42 | 32.73 |
| Composition | | | | | | |
| N2 | Mole % | 0.60 | 0.60 | 0.60 | 0.28 | 7.69 |
| METHANE | | 4.43 | 4.43 | 4.43 | 2.27 | 23.10 |
| C2H4 | | 15.89 | 15.89 | 15.89 | 8.71 | 39.22 |
| ETHANE | | 0.00 | 0.00 | 0.00 | 0.00 | 0.00 |
| C3 | | 18.31 | 18.31 | 18.31 | 14.54 | 11.13 |
| BUTANE | | 60.77 | 60.77 | 60.77 | 74.19 | 18.86 |
| High/Low Ranges | | | | | | |
| High Temperature | C. | | | | | |
| Low Temperature | C. | | | | | |
| High Pressure | BAR | | | | | |
| Low Pressure | BAR | | | | | |

TABLE 2-continued

| | | Stream Name | | | | |
|---|---|---|---|---|---|---|
| | | 108A | 112 | 122 | 124 | 128 |
| | | Stream Description | | | | |
| | | Low Pressure High Boiling Refrigerant Outlet | Subcooled Cold Separator Vapor | Low Pressure MR Inlet | Subcooled Mid Boiling Refrigerant | Subcooled Cold Separator Liquid |
| Phase | | Mixed | Liquid | Mixed | Liquid | Liquid |
| Temperature | C. | 31.01 | −163.00 | −166.52 | −95.00 | −91.72 |
| Pressure | BAR | 4.50 | 27.20 | 4.80 | 27.20 | 27.20 |
| Flowrate | KG-MOL/HR | 718.7 | 999.6 | 999.6 | 342.8 | 1,442.5 |
| Total Mass Rate | KG/HR | 37,676.0 | 23,204.5 | 23,204.5 | 16,704.5 | 51,244.6 |
| Total Molecular Weight | | 52.42 | 23.21 | 23.21 | 48.73 | 35.53 |
| Composition | | | | | | |
| N2 | Mole % | 0.28 | 18.94 | 18.94 | 0.60 | 1.57 |
| METHANE | | 2.27 | 43.44 | 43.44 | 4.43 | 13.44 |
| C2H4 | | 8.71 | 35.72 | 35.72 | 15.89 | 47.20 |
| ETHANE | | 0.00 | 0.00 | 0.00 | 0.00 | 0.00 |
| C3 | | 14.54 | 1.32 | 1.32 | 18.31 | 16.23 |
| BUTANE | | 74.19 | 0.58 | 0.58 | 60.77 | 21.56 |
| High/Low Ranges | | | | | | |
| High Temperature | C. | | −140.00 | −145.00 | −50.00 | −50.00 |
| Low Temperature | C. | | −170.00 | −175.00 | −135.00 | −135.00 |
| High Pressure | BAR | | 72.00 | 12.00 | 72.00 | 72.00 |
| Low Pressure | BAR | | 22.00 | 2.00 | 22.00 | 22.00 |

| | | Stream Name | | | | |
|---|---|---|---|---|---|---|
| | | 132 | 140 | 158 | 156 | 160 |
| | | Stream Description | | | | |
| | | Low Pressure Mid Boiling Refrigerant Inlet | Subcooled High Boiling Refrigerant | Low Pressure High Boiling Refrigerant Inlet | Cold Separator Liquid | Cold Separator Vapor |
| Phase | | Liquid | Liquid | Liquid | Liquid | Vapor |
| Temperature | C. | −93.97 | −65.00 | −64.49 | −39.00 | −39.00 |
| Pressure | BAR | 4.70 | 16.31 | 4.70 | 27.20 | 27.20 |
| Flowrate | KG-MOL/HR | 342.8 | 718.7 | 718.7 | 1,442.5 | 999.6 |
| Total Mass Rate | KG/HR | 16,704.5 | 37,676.0 | 37,676.0 | 51,244.6 | 23,204.5 |
| Total Molecular Weight | | 48.73 | 52.42 | 52.42 | 35.53 | 23.21 |
| Composition | | | | | | |
| N2 | Mole % | 0.60 | 0.28 | 0.28 | 1.57 | 18.94 |
| METHANE | | 4.43 | 2.27 | 2.27 | 13.44 | 43.44 |
| C2H4 | | 15.89 | 8.71 | 8.71 | 47.20 | 35.72 |
| ETHANE | | 0.00 | 0.00 | 0.00 | 0.00 | 0.00 |
| C3 | | 18.31 | 14.54 | 14.54 | 16.23 | 1.32 |
| BUTANE | | 60.77 | 74.19 | 74.19 | 21.56 | 0.58 |
| High/Low Ranges | | | | | | |
| High Temperature | C. | −55.00 | −20.00 | −25.00 | | |
| Low Temperature | C. | −140.00 | −90.00 | −95.00 | | |
| High Pressure | BAR | 12.00 | 25.00 | 12.00 | | |
| Low Pressure | BAR | 2.00 | 8.00 | 2.00 | | |

| | | Stream Name 164 Stream Description Cold Feed |
|---|---|---|
| | Separator | |
| Phase | | Mixed |
| Temperature | C. | −39.00 |
| Pressure | BAR | 27.20 |
| Flowrate | KG-MOL/HR | 2,442.0 |
| Total Mass Rate | KG/HR | 74,449.1 |
| Total Molecular Weight | | 30.49 |
| Composition | | |
| N2 | Mole % | 8.68 |
| METHANE | | 25.72 |
| C2H4 | | 42.50 |
| ETHANE | | 0.00 |

TABLE 2-continued

| | | |
|---|---|---|
| C3 | | 10.13 |
| BUTANE | | 12.97 |
| High/Low Ranges | | |
| High Temperature | C. | −20.00 |
| Low Temperature | C. | −80.00 |
| High Pressure | BAR | 72.00 |
| Low Pressure | BAR | 22.00 |

What is claimed is:

1. A system for cooling a fluid with a mixed refrigerant, comprising:

a. a heat exchanger featuring a feed fluid cooling passage having an inlet configured to receive a fluid feed stream and an outlet through which a cooled fluid product stream exits the feed fluid cooling passage, said heat exchanger also including a primary refrigeration passage, a high pressure liquid passage, a high pressure vapor passage, a cold separator vapor passage and a cold separator liquid passage;

b. a mixed refrigerant compression system including:

i) a first stage compressor configured to receive fluid from the primary refrigeration passage;

ii) a first stage aftercooler configured to receive compressed fluid from the first stage compressor;

iii) a high pressure accumulator having an inlet in fluid communication with the first stage aftercooler, a vapor outlet configured to provide a high pressure vapor stream to the high pressure vapor passage of the heat exchanger and a liquid outlet configured to provide a high pressure liquid stream to the high pressure liquid passage of the heat exchanger;

c. a cold vapor separator configured to receive a fluid stream from the high pressure vapor passage of the heat exchanger and having a cold separator vapor outlet configured to direct vapor to the cold separator vapor passage of the heat exchanger and a cold separator liquid outlet configured to direct liquid to the cold separator liquid passage of the heat exchanger;

d. a cold temperature expansion device configured to receive fluid from the cold separator vapor passage of the heat exchanger, said cold temperature expansion device featuring an outlet in fluid communication with the primary refrigeration passage of the heat exchanger;

e. a cold separator liquid expansion device configured to receive and flash fluid from the cold separator liquid passage of the heat exchanger and having a cold separator liquid expansion device outlet;

f. a high pressure liquid expansion device configured to receive and flash fluid from the high pressure liquid passage of the heat exchanger and having a high pressure liquid expansion device outlet;

g. said cold separator liquid expansion device outlet and said high pressure liquid expansion device outlet configured so that flashed fluid streams exiting said cold separator liquid expansion device outlet and said high pressure liquid expansion device outlet are combined to form a middle temperature refrigerant stream that is directed to the primary refrigeration passage;

h. a first temperature sensor configured to measure a first temperature of a vapor stream exiting the cold vapor separator vapor outlet; and i. a first fluid controller in communication with the first temperature sensor and configured to receive a predetermined first set point temperature and control a flow rate through the high pressure liquid expansion device based on the measured first temperature and the predetermined first set point temperature.

2. The system of claim 1 wherein the mixed refrigerant compression system further includes:

iv) an interstage separation device configured to receive cooled fluid from the first stage aftercooler, said interstage separation device including a vapor outlet and a liquid outlet;

v) a second stage compressor configured to receive a vapor stream from the vapor outlet of the interstage separation device;

vi) a second stage aftercooler having an inlet configured to receive a compressed vapor stream from the second stage compressor and an outlet in fluid communication with the inlet of the high pressure accumulator;

and wherein the heat exchanger further includes a pre-cool refrigeration passage and a pre-cool liquid passage, where the pre-cool liquid passage is configured to receive a high-boiling liquid stream from the liquid outlet of the interstage separation device;

and further comprising:

j. a pre-cool expansion device configured to receive and flash a subcooled high-boiling liquid stream from the pre-cool liquid passage of the heat exchanger and direct a flashed fluid stream to the pre-cool refrigeration passage of the heat exchanger.

3. The system of claim 2 wherein the primary refrigeration passage includes the pre-cool refrigeration passage.

4. The system of claim 2 further comprising a pre-cool expansion device controller, a pre-cool flow sensor configured to detect a flow rate of a fluid stream entering the pre-cool expansion device, a cold temperature flow sensor configured to detect a flow rate of a fluid stream flowing through the cold temperature expansion device;

wherein said pre-cool expansion device controller is in communication with the pre-cool flow sensor and the cold temperature flow sensor and said pre-cool expansion device controller is configured to control the pre-cool expansion device based on flow rates measured by the pre-cool flow sensor and the cold temperature flow sensor.

5. A system for cooling a fluid with a mixed refrigerant, comprising:

a. a heat exchanger featuring a feed fluid cooling passage having an inlet configured to receive a fluid feed stream and an outlet through which a cooled fluid product stream exits the feed fluid cooling passage, said heat exchanger also including a primary refrigeration passage, a high pressure liquid passage, a high pressure vapor passage, a cold separator vapor passage, a cold separator liquid passage, a pre-cool refrigeration passage and a pre-cool liquid passage;

b. a mixed refrigerant compression system including:
   i) a first stage compressor configured to receive fluid from the primary refrigeration passage;
   ii) a first stage aftercooler configured to receive compressed fluid from the first stage compressor;
   iii) a high pressure accumulator having an inlet in fluid communication with the first stage aftercooler, a vapor outlet configured to provide a high pressure vapor stream to the high pressure vapor passage of the heat exchanger and a liquid outlet configured to provide a high pressure liquid stream to the high pressure liquid passage of the heat exchanger;
   iv) an interstage separation device configured to receive cooled fluid from the first stage aftercooler, said interstage separation device including a vapor outlet and a liquid outlet, where the pre-cool liquid passage of the heat exchanger is configured to receive a high-boiling liquid stream from the liquid outlet of the interstage separation device;
   v) a second stage compressor configured to receive a vapor stream from the vapor outlet of the interstage separation device;
   vi) a second stage aftercooler having an inlet configured to receive a compressed vapor stream from the second stage compressor and an outlet in fluid communication with the inlet of the high pressure accumulator;

c. a cold vapor separator configured to receive a fluid stream from the high pressure vapor passage of the heat exchanger and having a cold separator vapor outlet configured to direct vapor to the cold separator vapor passage of the heat exchanger and a cold separator liquid outlet configured to direct liquid to the cold separator liquid passage of the heat exchanger;

d. a cold temperature expansion device configured to receive fluid from the cold separator vapor passage of the heat exchanger, said cold temperature expansion device featuring an outlet in fluid communication with the primary refrigeration passage of the heat exchanger;

e. a cold separator liquid expansion device configured to receive and flash fluid from the cold separator liquid passage of the heat exchanger and having a cold separator liquid expansion device outlet;

f. a high pressure liquid expansion device configured to receive and flash fluid from the high pressure liquid passage of the heat exchanger and having a high pressure liquid expansion device outlet;

g. said cold separator liquid expansion device outlet and said high pressure liquid expansion device outlet configured so that flashed fluid streams exiting said cold separator liquid expansion device outlet and said high pressure liquid expansion device outlet are combined to form a middle temperature refrigerant stream that is directed to the primary refrigeration passage;

h. a first temperature sensor configured to measure a first temperature of a fluid stream exiting the cold vapor separator;

i. a first fluid controller in communication with the first temperature sensor and configured to receive a predetermined first set point temperature and control a flow rate through the cold separator liquid expansion device or the high pressure liquid expansion device based on the measured first temperature and the predetermined first set point temperature;

j. a pre-cool expansion device configured to receive and flash a subcooled high-boiling liquid stream from the pre-cool liquid passage of the heat exchanger and direct a flashed fluid stream to the pre-cool refrigeration passage of the heat exchanger;

k. a pre-cool expansion device controller, a pre-cool flow sensor configured to detect a flow rate of a fluid stream entering the pre-cool expansion device, and a cold temperature flow sensor configured to detect a flow rate of a fluid stream flowing through the cold temperature expansion device, wherein said pre-cool expansion device controller is in communication with the pre-cool flow sensor and the cold temperature flow sensor and said pre-cool expansion device controller is configured to control the pre-cool expansion device based on flow rates measured by the pre-cool flow sensor and the cold temperature flow sensor;

wherein the pre-cool expansion device controller is configured to control the pre-cool expansion device based on a ratio of a flow rate measured by the pre-cool flow sensor over a flow rate measured by the cold temperature flow sensor.

6. The system of claim 4 wherein the cold temperature flow sensor includes a cold temperature flow controller configured to control the cold temperature expansion device.

7. A system for cooling a fluid with a mixed refrigerant, comprising:

a. a heat exchanger featuring a feed fluid cooling passage having an inlet configured to receive a fluid feed stream and an outlet through which a cooled fluid product stream exits the feed fluid cooling passage, said heat exchanger also including a primary refrigeration passage, a high pressure liquid passage, a high pressure vapor passage, a cold separator vapor passage, a cold separator liquid passage, a pre-cool refrigeration passage and a pre-cool liquid passage;

b. a mixed refrigerant compression system including:
   i) a first stage compressor configured to receive fluid from the primary refrigeration passage;
   ii) a first stage aftercooler configured to receive compressed fluid from the first stage compressor;
   iii) a high pressure accumulator having an inlet in fluid communication with the first stage aftercooler, a vapor outlet configured to provide a high pressure vapor stream to the high pressure vapor passage of the heat exchanger and a liquid outlet configured to provide a high pressure liquid stream to the high pressure liquid passage of the heat exchanger;
   iv) an interstage separation device configured to receive cooled fluid from the first stage aftercooler, said interstage separation device including a vapor outlet and a liquid outlet, where the pre-cool liquid passage of the heat exchanger is configured to receive a high-boiling liquid stream from the liquid outlet of the interstage separation device;
   v) a second stage compressor configured to receive a vapor stream from the vapor outlet of the interstage separation device;
   vi) a second stage aftercooler having an inlet configured to receive a compressed vapor stream from the second stage compressor and an outlet in fluid communication with the inlet of the high pressure accumulator;

c. a cold vapor separator configured to receive a fluid stream from the high pressure vapor passage of the heat exchanger and having a cold separator vapor outlet configured to direct vapor to the cold separator vapor passage of the heat exchanger and a cold separator liquid outlet configured to direct liquid to the cold separator liquid passage of the heat exchanger;

d. a cold temperature expansion device configured to receive fluid from the cold separator vapor passage of the heat exchanger, said cold temperature expansion device featuring an outlet in fluid communication with the primary refrigeration passage of the heat exchanger;

e. a cold separator liquid expansion device configured to receive and flash fluid from the cold separator liquid passage of the heat exchanger and having a cold separator liquid expansion device outlet;

f. a high pressure liquid expansion device configured to receive and flash fluid from the high pressure liquid passage of the heat exchanger and having a high pressure liquid expansion device outlet;

g. said cold separator liquid expansion device outlet and said high pressure liquid expansion device outlet configured so that flashed fluid streams exiting said cold separator liquid expansion device outlet and said high pressure liquid expansion device outlet are combined to form a middle temperature refrigerant stream that is directed to the primary refrigeration passage;

h. a first temperature sensor configured to measure a first temperature of a stream entering the cold separator liquid expansion device; and i. a first fluid controller in communication with the first temperature sensor and configured to receive a predetermined first set point temperature and control a flow rate through the cold separator liquid expansion device based on the measured first temperature and the predetermined first set point temperature;

j. a pre-cool expansion device configured to receive and flash a subcooled high-boiling liquid stream from the pre-cool liquid passage of the heat exchanger and direct a flashed fluid stream to the pre-cool refrigeration passage of the heat exchanger;

k. a pre-cool expansion device controller, a pre-cool flow sensor configured to detect a flow rate of a fluid stream entering the pre-cool expansion device, and a cold temperature flow sensor configured to detect a flow rate of a fluid stream flowing through the cold temperature expansion device, wherein said pre-cool expansion device controller is in communication with the pre-cool flow sensor and the cold temperature flow sensor and said pre-cool expansion device controller is configured to control the pre-cool expansion device based on flow rates measured by the pre-cool flow sensor and the cold temperature flow sensor;

and wherein the first fluid controller includes a cold separator liquid flow sensor configured to measure a flow rate of a fluid flowing through the cold separator liquid expansion device;

and further comprising a high pressure liquid expansion device controller and a high pressure liquid flow sensor configured to measure a flow rate of fluid flowing into the high pressure liquid expansion device, said high pressure liquid expansion device controller in communication with the high pressure liquid flow sensor, the cold separator liquid flow sensor and the cold temperature flow sensor and configured to control the high pressure liquid expansion device based on flows measured by the high pressure liquid flow sensor, the cold separator liquid flow sensor and the cold temperature flow sensor.

8. The system of claim 7 further comprising a liquid level sensor configured to determine a liquid level in the cold vapor separator, said liquid level sensor in communication with the first fluid controller and wherein said first fluid controller is configured to control the cold separator liquid expansion device based on cold vapor separator liquid level data from the liquid level sensor.

9. The system of claim 8 further comprising a second temperature sensor configured to measure a temperature of a vapor stream exiting the cold vapor separator vapor outlet and a high pressure liquid flow controller, said high pressure liquid flow controller in communication with the second temperature sensor and the high pressure liquid expansion device, wherein said high pressure liquid flow controller is configured to receive a predetermined second set point temperature and control a flow rate through the high pressure liquid expansion device based on a temperature measured by the second temperature sensor and the predetermined second set point temperature.

10. A system for cooling a fluid with a mixed refrigerant, comprising:

a. a heat exchanger featuring a feed fluid cooling passage having an inlet configured to receive a fluid feed stream and an outlet through which a cooled fluid product stream exits the feed fluid cooling passage, said heat exchanger also including a primary refrigeration passage, a high pressure liquid passage, a high pressure vapor passage, a cold separator vapor passage, a cold separator liquid passage, a pre-cool refrigeration passage and a pre-cool liquid passage;

b. a mixed refrigerant compression system including:

i) a first stage compressor configured to receive fluid from the primary refrigeration passage;

ii) a first stage aftercooler configured to receive compressed fluid from the first stage compressor;

iii) a high pressure accumulator having an inlet in fluid communication with the first stage aftercooler, a vapor outlet configured to provide a high pressure vapor stream to the high pressure vapor passage of the heat exchanger and a liquid outlet configured to provide a high pressure liquid stream to the high pressure liquid passage of the heat exchanger;

iv) an interstage separation device configured to receive cooled fluid from the first stage aftercooler, said interstage separation device including a vapor outlet and a liquid outlet, where the pre-cool liquid passage of the heat exchanger is configured to receive a high-boiling liquid stream from the liquid outlet of the interstage separation device;

v) a second stage compressor configured to receive a vapor stream from the vapor outlet of the interstage separation device;

vi) a second stage aftercooler having an inlet configured to receive a compressed vapor stream from the second stage compressor and an outlet in fluid communication with the inlet of the high pressure accumulator;

c. a cold vapor separator configured to receive a fluid stream from the high pressure vapor passage of the heat exchanger and having a cold separator vapor outlet configured to direct vapor to the cold separator vapor passage of the heat exchanger and a cold separator liquid outlet configured to direct liquid to the cold separator liquid passage of the heat exchanger;

d. a cold temperature expansion device configured to receive fluid from the cold separator vapor passage of the heat exchanger, said cold temperature expansion device featuring an outlet in fluid communication with the primary refrigeration passage of the heat exchanger;

e. a cold separator liquid expansion device configured to receive and flash fluid from the cold separator liquid passage of the heat exchanger and having a cold separator liquid expansion device outlet;

f. a high pressure liquid expansion device configured to receive and flash fluid from the high pressure liquid passage of the heat exchanger and having a high pressure liquid expansion device outlet;

g. said cold separator liquid expansion device outlet and said high pressure liquid expansion device outlet configured so that flashed fluid streams exiting said cold separator liquid expansion device outlet and said high pressure liquid expansion device outlet are combined to form a middle temperature refrigerant stream that is directed to the primary refrigeration passage;

h. a first temperature sensor configured to measure a first temperature of a vapor stream exiting the cold vapor separator vapor outlet;

i. a first fluid controller in communication with the first temperature sensor and configured to receive a predetermined first set point temperature and control a flow rate through the high pressure liquid expansion device based on the measured first temperature and the predetermined first set point temperature;

j. a pre-cool expansion device configured to receive and flash a subcooled high-boiling liquid stream from the pre-cool liquid passage of the heat exchanger and direct a flashed fluid stream to the pre-cool refrigeration passage of the heat exchanger;

k. a pre-cool expansion device controller, a pre-cool flow sensor configured to detect a flow rate of a fluid stream entering the pre-cool expansion device, and a cold temperature flow sensor configured to detect a flow rate of a fluid stream flowing through the cold temperature expansion device, wherein said pre-cool expansion device controller is in communication with the pre-cool flow sensor and the cold temperature flow sensor and said pre-cool expansion device controller is configured to control the pre-cool expansion device based on flow rates measured by the pre-cool flow sensor and the cold temperature flow sensor; and l. a high pressure liquid flow sensor configured to measure a flow rate of fluid flowing into the high pressure liquid expansion device, said first fluid controller in communication with the high pressure liquid flow sensor, the cold separator liquid flow sensor and the cold temperature flow sensor and configured to control the high pressure liquid expansion device based on flows measured by the high pressure liquid flow sensor, the cold separator liquid flow sensor and the cold temperature flow sensor.

11. The system of claim 10 further comprising a liquid level sensor configured to determine a liquid level in the cold vapor separator and a cold separator liquid flow controller, said cold separator liquid flow controller in communication with the liquid level sensor and the cold separator liquid expansion device wherein said cold separator flow controller is configured to control the cold separator liquid expansion device based on cold vapor separator liquid level data from the liquid level sensor.

12. The system of claim 5 wherein the first temperature sensor is configured to measure a temperature of the fluid stream exiting the cold vapor separator and entering the cold separator liquid expansion device and the first fluid controller is configured to control the cold separator liquid expansion device.

13. A system for cooling a fluid with a mixed refrigerant, comprising:

a. a heat exchanger featuring a feed fluid cooling passage having an inlet configured to receive a fluid feed stream and an outlet through which a cooled fluid product stream exits the feed fluid cooling passage, said heat exchanger also including a primary refrigeration passage, a high pressure liquid passage, a high pressure vapor passage, a cold separator vapor passage and a cold separator liquid passage;

b. a mixed refrigerant compression system including:

i) a first stage compressor configured to receive fluid from the primary refrigeration passage;

ii) a first stage aftercooler configured to receive compressed fluid from the first stage compressor;

iii) a high pressure accumulator having an inlet in fluid communication with the first stage aftercooler, a vapor outlet configured to provide a high pressure vapor stream to the high pressure vapor passage of the heat exchanger and a liquid outlet configured to provide a high pressure liquid stream to the high pressure liquid passage of the heat exchanger;

c. a cold vapor separator configured to receive a fluid stream from the high pressure vapor passage of the heat exchanger and having a cold separator vapor outlet configured to direct vapor to the cold separator vapor passage of the heat exchanger and a cold separator liquid outlet configured to direct liquid to the cold separator liquid passage of the heat exchanger;

d. a cold temperature expansion device configured to receive fluid from the cold separator vapor passage of the heat exchanger, said cold temperature expansion device featuring an outlet in fluid communication with the primary refrigeration passage of the heat exchanger;

e. a cold separator liquid expansion device configured to receive and flash fluid from the cold separator liquid passage of the heat exchanger and having a cold separator liquid expansion device outlet;

f. a high pressure liquid expansion device configured to receive and flash fluid from the high pressure liquid passage of the heat exchanger and having a high pressure liquid expansion device outlet;

g. said cold separator liquid expansion device outlet and said high pressure liquid expansion device outlet configured so that flashed fluid streams exiting said cold separator liquid expansion device outlet and said high pressure liquid expansion device outlet are combined to form a middle temperature refrigerant stream that is directed to the primary refrigeration passage;

h. a first temperature sensor configured to measure a first temperature of a stream entering the cold separator liquid expansion device; and i. a first fluid controller in communication with the first temperature sensor and configured to receive a predetermined first set point temperature and control a flow rate through the cold separator liquid expansion device based on the measured first temperature and the predetermined first set point temperature;

j. a liquid level sensor configured to determine a liquid level in the cold vapor separator, said liquid level sensor in communication with the first fluid controller and wherein said first fluid controller is configured to control the cold separator liquid expansion device based on cold vapor separator liquid level data from the liquid level sensor.

14. The system of claim 12 further comprising a second temperature sensor configured to measure a temperature of a vapor stream exiting the cold vapor separator vapor outlet and a high pressure liquid flow controller, said high pressure liquid flow controller in communication with the second temperature sensor and the high pressure liquid expansion device, wherein said high pressure liquid flow controller is configured to receive a predetermined second set point temperature and control a flow rate through the high pressure liquid expansion device based on a temperature measured by the second temperature sensor and the predetermined second set point temperature.

15. The system of claim 12 wherein ethylene or ethane is sequestered or released from the cold vapor separator based on control of the cold separator liquid expansion device.

16. The system of claim 1 further comprising a liquid level sensor configured to determine a liquid level in the cold vapor separator and a cold separator liquid flow controller, said cold separator liquid flow controller in communication with the liquid level sensor and the cold separator liquid expansion device wherein said cold separator flow controller is configured to control the cold separator liquid expansion device based on cold vapor separator liquid level data from the liquid level sensor.

17. The system of claim 1 wherein circulation rates of butane and propane relative to other components of the mixed refrigerant are adjusted based on control of the high pressure liquid expansion device.

* * * * *